US011047016B2

(12) United States Patent
Furrer et al.

(10) Patent No.: US 11,047,016 B2
(45) Date of Patent: Jun. 29, 2021

(54) TECHNIQUES FOR CONTROLLING PRECIPITATE PHASE DOMAIN SIZE IN AN ALLOY

(71) Applicant: Rolls-Royce Corporation, Indianapolis, IN (US)

(72) Inventors: David Ulrich Furrer, Brownsburg, IN (US); Randolph C. Helmink, Avon, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 49 days.

(21) Appl. No.: 16/229,459

(22) Filed: Dec. 21, 2018

(65) Prior Publication Data

US 2019/0119766 A1 Apr. 25, 2019

Related U.S. Application Data

(62) Division of application No. 14/254,876, filed on Apr. 16, 2014, now Pat. No. 10,184,156, which is a (Continued)

(51) Int. Cl.
*C21D 1/00* (2006.01)
*C22F 1/00* (2006.01)
(Continued)

(52) U.S. Cl.
CPC ..... *C21D 1/00* (2013.01); *C22F 1/00* (2013.01); *C22F 1/10* (2013.01); *C22F 1/183* (2013.01); *C21D 2221/00* (2013.01)

(58) Field of Classification Search
None
See application file for complete search history.

(56) References Cited

U.S. PATENT DOCUMENTS 4,820,356 A 4/1989 Blackburn et al.
5,312,497 A 5/1994 Mathey
(Continued)

FOREIGN PATENT DOCUMENTS

JP 03064435 A 3/1991

OTHER PUBLICATIONS

Prosecution History from parent U.S. Appl. No. 12/755,170, dated Aug. 24, 2012 through Jan. 2, 2014, 74 pp.
(Continued)

*Primary Examiner* — Colin W. Slifka
(74) *Attorney, Agent, or Firm* — Shumaker & Sieffert, P.A.

(57) ABSTRACT

A heat treatment technique may include heating an alloy component to a temperature above a transition temperature of the alloy or heating an alloy component to a temperature below the transition temperature of the alloy. The heat treatment technique further may include cooling a first portion of the alloy component at a first cooling rate, and cooling a second portion of the alloy component at a second cooling rate different than the first rate. The first cooling rate may result in formation of a plurality of first precipitate phase domains comprising a first average size in the first portion, and the second cooling rate may result in formation of a plurality of second precipitate phase domains comprising a second average size in the second portion. The average size of the first precipitate phase domains may be different than the average size of the second precipitate phase domains.

8 Claims, 12 Drawing Sheets

Related U.S. Application Data division of application No. 12/755,170, filed on Apr. 6, 2010, now Pat. No. 8,721,812.

(60) Provisional application No. 61/167,412, filed on Apr. 7, 2009.

(51) Int. Cl.
*C22F 1/10* (2006.01)
*C22F 1/18* (2006.01)

(56) References Cited

U.S. PATENT DOCUMENTS

| | | | | |
|---|---|---|---|---|
| 5,447,580 | A | 9/1995 | Semiatin et al. | |
| 5,527,020 | A | 6/1996 | Ganesh et al. | |
| 5,571,345 | A * | 11/1996 | Ganesh | B22F 3/24 148/514 |
| 6,660,110 | B1 | 12/2003 | Gayda et al. | |
| 7,896,986 | B2 | 3/2011 | Kottilingam et al. | |
| 8,551,266 | B2 | 10/2013 | Imamovic et al. | |
| 8,721,812 | B2 | 5/2014 | Furrer et al. | |
| 9,103,002 | B2 | 8/2015 | Decker | |
| 2014/0224384 | A1 | 8/2014 | Furrer et al. | |

OTHER PUBLICATIONS

Prosecution History from parent U.S. Appl. No. 14/254,876, dated Jun. 6, 2017 through Dec. 5, 2018, 35 pp.

* cited by examiner

TECHNIQUES FOR CONTROLLING PRECIPITATE PHASE DOMAIN SIZE IN AN ALLOY

CROSS REFERENCE TO RELATED APPLICATIONS

This application is a divisional of U.S. patent application Ser. No. 14/254,876, entitled "TECHNIQUES FOR CONTROLLING PRECIPITATE PHASE DOMAIN SIZE IN AN ALLOY" and filed on Apr. 16, 2014, which is a divisional of U.S. patent application Ser. No. 12/755,170, entitled "TECHNIQUES FOR CONTROLLING PRECIPITATE PHASE DOMAIN SIZE IN AN ALLOY" and filed on Apr. 6, 2010, and issued as U.S. Pat. No. 8,721,812 on May 13, 2014, which claims the benefit of U.S. Provisional Application No. 61/167,412, entitled "TECHNIQUES FOR CONTROLLING PRECIPITATE PHASE DOMAIN SIZE IN AN ALLOY" and filed on Apr. 7, 2009, the entire contents of each of which is incorporated herein by reference.

TECHNICAL FIELD

The disclosure relates to alloys, and more particularly, methods of forming microstructure in alloys.

BACKGROUND

The components of high-temperature mechanical systems, such as, for example, gas-turbine engines, must operate in severe environments. For example, the high-pressure turbine blades, vanes, blade tracks, and blade shrouds are exposed directly to hot flow path gases in commercial aeronautical engines and typically experience metal surface temperatures of about 800° C., with short-term peaks as high as 1100° C. The rim portion of a turbine disk may experience high temperatures of between approximately 600° C. and 750° C.

On the other hand, the hub portion of the turbine disk may not be exposed to such high temperatures, but may experience higher mechanical stresses. Thus, it may be desired for the hub portion of the turbine disk to possess different mechanical properties than the rim portion of the turbine disk.

One technique of providing different mechanical properties to two portions of a single component is to process the component in such a way that a grain size in one portion of the component is different than the grain size in a second portion of the article.

SUMMARY

However, further control of the microstructure of the component may be desirable. For example, some components of a high temperature mechanical system may be formed of high temperature alloys, such as, for example, a nickel-based $\gamma$-Ni+$\gamma'$-$Ni_3Al$ alloy (a superalloy) that which includes a matrix phase of $\gamma$-Ni and a precipitate phase of $\gamma'$-$Ni_3Al$. Other components that experience lower temperatures may utilize another two-phase alloy system, such as a titanium alloy or an aluminum alloy. In alloy components such as these, further control of the mechanical properties of the component may be achieved by controlling the formation of the precipitate phase domains, and more particularly, controlling at least one of the average size, quantity or spatial distribution of the precipitate phase domains.

In general, the present disclosure is directed to techniques for controlling formation of microstructure, such as precipitate phase domains, in an alloy component. The average size of the precipitate phase domains may influence properties of the alloy component. For example, a relatively fine average precipitate phase domain size may result in an alloy component that has desirable low temperature strength, creep resistance, and/or fatigue resistance, while a relatively coarse average precipitate phase domain size may result in an alloy component that has desirable elevated temperature creep resistance, elevated temperature fatigue resistance, and/or improved damage tolerance.

The techniques for controlling formation of precipitate phase domains in the alloy component may include controlling at least one heat treatment parameter that defines how an alloy component is heat-treated. The heat treatment parameter may include, for example, a heat treatment temperature, a heat treatment duration, or a rate at which the alloy component is cooled from a heat treatment temperature. In some embodiments, at least one heat treatment parameter may be different for a first portion of the alloy component than for a second portion of the alloy component.

In some embodiments, the heat treatment may occur at a temperature below a transition temperature of the alloy, which may result in dissolution of some of the precipitate phase domains. For example, in some embodiments the precipitate phase domains may include at least one of primary precipitate phase domains, secondary precipitate phase domains, or tertiary precipitate phase domains. As one example, a $\gamma$-Ni+$\gamma'$-$Ni_3Al$ may include $\gamma'$-$Ni_3Al$ domains that include at least one of primary, secondary or tertiary precipitate phase domains. When a $\gamma$-Ni+$\gamma'$-$Ni_3Al$ alloy is heat treated below a transition temperature of the alloy, any secondary or tertiary $\gamma'$-$Ni_3Al$ precipitate phase domains present in the alloy may substantially dissolve in the $\gamma$-Ni matrix, while any primary $\gamma'$-$Ni_3Al$ primary precipitate phase domains remain substantially undissolved and may even coarsen. When the alloy is cooled from the heat treatment temperature, secondary $\gamma'$-$Ni_3Al$ precipitate phase domains may form during the cooling at relatively high temperatures, while tertiary $\gamma'$-$Ni_3Al$ precipitate phase domains may form during the cooling at lower temperatures.

In some embodiments in which the alloy component is heat treated at a temperature below a transition temperature of the alloy component, a first portion of the alloy component may be heated to a first temperature and a second portion of the alloy component may be heated to a second temperature different than the first temperature. Each of the first and second temperatures may be below the transition temperature but above a minimum temperature above which precipitate phase domain growth or dissolution occurs. The different first and second temperatures may result in different precipitate phase domain dynamics, which may lead to different precipitate phase domain characteristics in the first and second portions of the component. In some examples, the first and second portions may be cooled at substantially similar cooling rates, while in other embodiments, the first and second portions may be cooled at different cooling rates.

In other embodiments, the heat treatment may occur at a temperature above a transition temperature of the alloy, which may result in dissolution of substantially all of the precipitate phase domains. For example, a $\gamma$-Ni+$\gamma'$-$Ni_3Al$ may include $\gamma'$-$Ni_3Al$ domains that include at least one of primary, secondary or tertiary precipitate phase domains. When a $\gamma$-Ni+$\gamma'$-$Ni_3Al$ alloy is heat treated above a transition temperature of the alloy, substantially all of the precipitate phase domains, including primary, secondary and/or tertiary γ'-$Ni_3Al$ precipitate phase domains, may substantially dissolve in the γ-Ni matrix. When the alloy is cooled from the heat treatment temperature, secondary γ'-$Ni_3Al$ precipitate phase domains may form during the cooling at relatively high temperatures below the transition temperature, while tertiary γ'-$Ni_3Al$ precipitate phase domains may form during the cooling at lower temperatures. Other alloy systems may have similar precipitate phase domains and undergo similar precipitate phase domain formation, although the number and shape of the precipitate phase domains may be different.

In one aspect, the disclosure is directed to a method that includes heating substantially an entire alloy component to a temperature above a transition temperature of the alloy, cooling a first portion of the alloy component at a first cooling rate, and cooling a second portion of the alloy component at a second cooling rate different than the first rate. The first cooling rate may result in formation of a plurality of first precipitate phase domains comprising a first average size in the first portion, and the second cooling rate may result in formation of a plurality of second precipitate phase domains comprising a second average size in the second portion. According to this aspect of the disclosure, the first average size is different than the second average size.

In another aspect, the disclosure is directed to a method including heating substantially an entire alloy component to a temperature below a transition temperature of the alloy, cooling a first portion of the alloy component at a first cooling rate, and cooling a second portion of the alloy component at a second cooling rate different than the first rate. The first cooling rate may result in a plurality of first precipitate phase domains comprising a first average size in the first portion, and the second cooling rate may result in a plurality of second precipitate phase domains comprising a second average size in the second portion. According to this aspect of the disclosure, the first average size is different than the second average size.

In yet another aspect, the disclosure is directed to a method including heating a first portion of an alloy component comprising a plurality of precipitate phase domains in a matrix phase to a coarsening temperature to coarsen at least some of the plurality of precipitate phase domains, and maintaining a temperature of a second portion of the alloy component at a temperature that substantially prevents coarsening of precipitate phase domains in the second portion.

In a further aspect, the disclosure is directed to a method including heating a first portion of an alloy component to a first temperature and heating a second portion of the alloy component to a second temperature. According to this aspect of the disclosure, the first temperature is below a transition temperature of the alloy component and above a minimum temperature sufficient to initiate precipitate domain formation and the second temperature is below the transition temperature of the alloy component and above the minimum temperature sufficient to initiate precipitate domain formation. The second temperature is different than the first temperature. The method further includes cooling the first portion and the second portion to result in a first plurality of precipitate phase domains comprising a first average size in the first portion and a second plurality of precipitate phase domains comprising a second average size in the second portion. According to this aspect of the disclosure, the first average size may be different than the second average size.

The details of one or more embodiments of the disclosure are set forth in the accompanying drawings and the description below. Other features, objects, and advantages will be apparent from the description and drawings, and from the claims.

DETAILED DESCRIPTION

Figure 1:
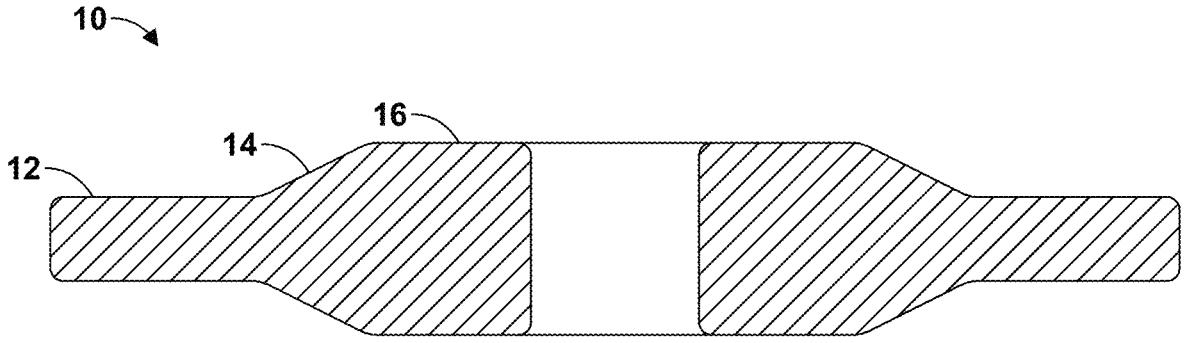
FIG. 1 is a conceptual cross-sectional diagram illustrating an example alloy component.

In general, the present disclosure is directed to techniques for controlling formation of microstructure, such as precipitate phase domains, in an alloy component. In the present disclosure, precipitate phase domains are domains of a discontinuous metallurgical phase formed in a matrix of a continuous metallurgical phase.

In some embodiments, an alloy component may comprise a $\gamma$-Ni+$\gamma'$-$Ni_3Al$ alloy. In such embodiments, the $\gamma$-Ni may be the continuous phase, e.g., the matrix, and the $\gamma'$-$Ni_3Al$ may be the discontinuous phase, e.g., the precipitate. The $\gamma'$-$Ni_3Al$ phase may segregate into distinct, substantially homogeneous domains within the $\gamma$-Ni matrix phase. In other embodiments, an alloy component may comprise a titanium alloy that includes precipitate phase domains within a matrix phase or an aluminum alloy that includes precipitate phase domains within a matrix phase. By controlling precipitate phase domain formation, the resulting average size, quantity or spatial distribution of the precipitate phase domains may be controlled.

The average size, quantity and/or spatial distribution of the precipitate phase domains may influence the properties of the alloy component. For example, a relatively fine average precipitate phase domain size may result in an alloy component that has desirable low temperature strength and creep resistance, while a relatively coarse average precipitate phase domain size may result in an alloy component that has improved elevated temperature creep resistance, improved damage tolerance, and improved resistance to dwell-fatigue.

The techniques for controlling formation of precipitate phase domains in the alloy component may include controlling at least one heat treatment parameter, which defines how an alloy component is heat-treated. The heat treatment parameter may include, for example, a heat treatment temperature, a heat treatment duration, or a rate at which the alloy component is cooled from a heat treatment temperature. In some embodiments, one or more heat treatment parameter may be different for a first portion of the alloy component than for a second portion of the alloy component. As one example, substantially the entire the alloy component may be heated to a substantially uniform temperature. Once the heating is complete, a first portion of the alloy component may be cooled at a first cooling rate and a second portion of the alloy component may be cooled at a second cooling rate. The first and second cooling rates may be different, and may result in different average precipitate phase domain sizes in the first portion and the second portion of the alloy component, respectively.

In some embodiments, the precipitate phase domains may be classified as primary precipitate phase domains, secondary precipitate phase domains, tertiary precipitate phase domains, or combinations thereof. The designation of primary, secondary or tertiary may refer to the method by which the precipitate phase domains are formed or how the precipitate phase domains respond to heat treatment. For example, primary precipitate phase domains may remain substantially undissolved and may even coarsen when an alloy is exposed to a heat treatment below a transition temperature of the alloy. In some embodiments, the volume fraction of primary precipitate phase domains is controlled by the temperature at which the heat treatment is performed and the size of the primary precipitate phase domains is controlled by the duration of the heat treatment. In contrast, secondary precipitate phase domains substantially dissolve in the matrix phase when the alloy is exposed to a heat treatment above a low temperature threshold and below a transition temperature of the alloy. Secondary precipitate phase domains form during cooling of the alloy from relatively high temperatures. Tertiary precipitate phase domains may also dissolve in the in the matrix phase when the alloy is exposed to a heat treatment above a low temperature threshold and below a transition temperature of the alloy. Tertiary precipitate phase domains may form during cooling of the alloy at relatively lower temperatures. In addition, tertiary precipitate phase domains may coarsen during aging, while primary and secondary precipitate phase domains may be relatively unaffected by aging.

FIG. 1 is a conceptual diagram illustrating a cross-section of an example alloy component. In the illustrated example, the alloy component includes a gas turbine engine disk 10 used in a gas turbine engine. Gas turbine engine disk 10 includes a rim portion 12, a web portion 14, and a bore portion 16. In various embodiments, gas turbine engine disk 10 may be a low or high pressure compressor disk (LPC or HPC), a low or high pressure turbine disk (LPT or HPT), or a fan disk.

Gas turbine engine disk 10 may be formed of a wide range of alloys, including for example, Ni-based superalloy. In some embodiments, gas turbine engine disk 10 may be formed of a $\gamma$-Ni+$\gamma'$-$Ni_3Al$ alloy, while in other embodiments, gas turbine engine disk 10 may be formed from another alloy system that has multiple phases which can be altered by thermal processing, such as a titanium-based alloy or an aluminum-based alloy.

Although the following description will be directed primarily to a gas turbine engine disk 10 formed of a $\gamma$-Ni+$\gamma'$-$Ni_3Al$ alloy, in other embodiments, the alloy component may comprise a different article or component than a gas turbine engine disk 10, or may comprise a different alloy. For example, the alloy component may be another component of a high temperature mechanical system, such as a turbine blade or a shaft for an aero-engine, or may comprise another alloy article that may benefit from including two different average precipitate phase domain sizes in two portions of the article. In addition, the techniques described herein may be applied to other alloys, such as, for example, steel, aluminum alloys, titanium alloys, or the like. In some embodiments the component may include two or more alloys joined together, e.g., a dual alloy gas turbine engine disk. The techniques described herein may be applied to control formation of precipitate phase domains in each of the two or more alloys, and may be utilized to control formation of precipitate phase domains in respective portions of at least one of the alloys.

When used in a gas turbine engine, bore portion 16 may experience lower operating temperatures than rim portion 12. Accordingly, it may be desired that hub portion 16 has different mechanical characteristics than rim portion 12. For example, bore portion 16 may benefit from having high tensile strength and high fatigue strength at lower temperatures, while rim portion 12 may benefit from having improved elevated temperature creep resistance, improved damage tolerance, and improved resistance to dwell-fatigue. These considerations may lead to the desire to form bore portion 16 and rim portion 12 with different microstructures, such as, for example, different average precipitate phase domain sizes.

Figure 2:
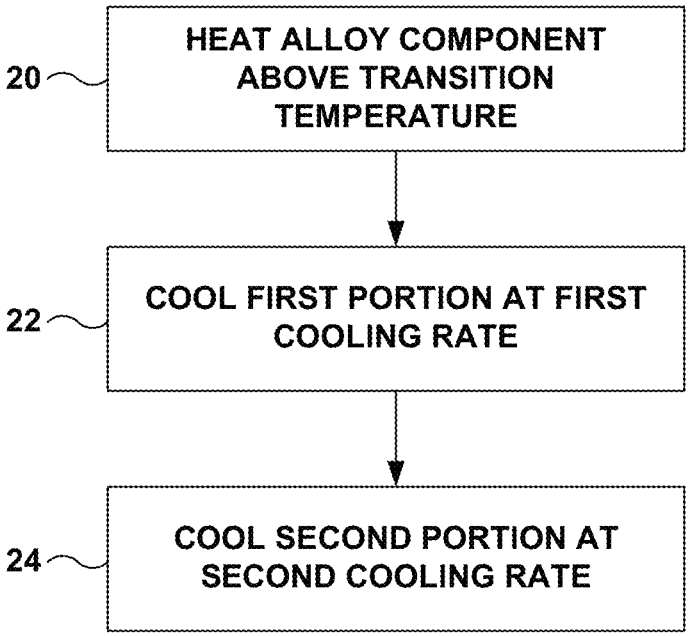
FIG. 2 is a flow diagram illustrating an example technique of heat treating an alloy component to produce a first average precipitate phase domain size in a first portion of the alloy component and a second average precipitate phase domain size in a second portion of the alloy component.
Figure 3A:
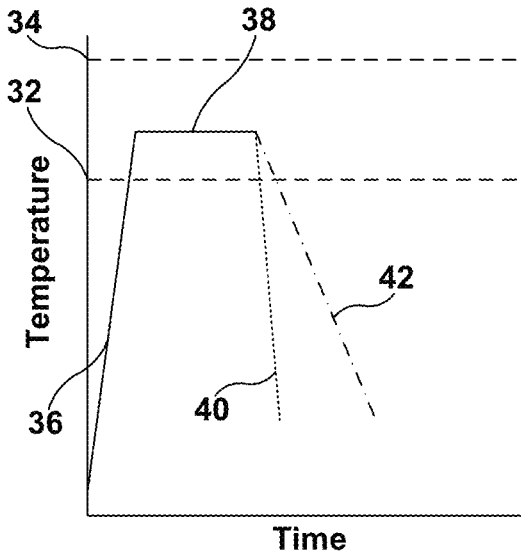
FIGS. 3A and 3B are time-temperature diagrams illustrating example heat treatments to which an alloy component may be exposed.
Figure 3B:
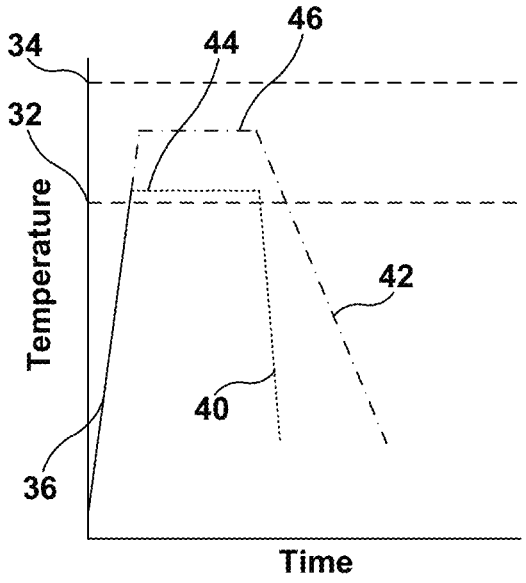

FIG. 2 is a flow diagram illustrating an example technique for forming a first average precipitate phase domain size in a first portion of an alloy component, e.g., bore portion 16 of turbine disk 10, and a second average precipitate phase domain size in a second portion of the alloy component, e.g., rim portion 12 of turbine disk 10. FIG. 2 will be described with concurrent reference to FIGS. 3A and 3B, which are time-temperature diagrams for two examples of heat-treating an alloy component. While the techniques illustrated in FIGS. 2, 3A, and 3B are directed to forming an alloy component with two different portions having different average precipitate phase domain sizes, in other embodiments, an alloy component may be formed to include three or more portions, each having similar or different average precipitate phase domain sizes. Accordingly, the present disclosure is not limited to techniques for forming an alloy component including two portions having different average precipitate phase domain sizes.

Initially, the alloy component may be heated above a transition temperature 32 of the alloy (20), which is represented in FIGS. 3A and 3B as the first portion 36 of the time-temperature curves. The alloy component may be heated to a temperature above the transition temperature 32, but below a melting temperature 34 of the alloy component, to prevent melting of the component. The transition temperature 32 may comprise, for example, a temperature at which an alloy transforms from a first crystalline phase to a second crystalline phase or a temperature at which an alloy transforms from a binary (or ternary, quaternary, or the like) mixture to a solid solution, or vice versa. For a nickel-based superalloy or an aluminum alloy, the transition temperature 32 may be referred to as a solvus temperature, which is the temperature above which a two-phase (or multiple phase) alloy forms solid solution in which one of the phases is dissolved in the other phase. A similar transition temperature for a titanium alloy is referred to as a transus temperature.

For example, in some embodiments, the alloy component may be formed of a $\gamma$-Ni+$\gamma'$-$Ni_3Al$ alloy. As described above, the transition temperature 32 for the $\gamma$-Ni+$\gamma'$-$Ni_3Al$ alloy is referred to as the $\gamma'$-$Ni_3Al$ solvus temperature, which is the temperature above which the $\gamma'$-$Ni_3Al$, including primary $\gamma'$-$Ni_3Al$ precipitate phase domains, secondary $\gamma'$-$Ni_3Al$ precipitate phase domains, and tertiary $\gamma'$-$Ni_3Al$ precipitate phase domains, substantially fully dissolves in the $\gamma$-Ni phase to form a solid solution. In some examples, the $\gamma'$-$Ni_3Al$ solvus temperature may be between approximately 1915° F. and approximately 2150° F. and the melting temperature may be between approximately 2150° F. and approximately 2350° F. Of course, the $\gamma'$-$Ni_3Al$ solvus temperature and melting temperature will depend on the precise composition of the alloy, and other $\gamma$-Ni+$\gamma'$-$Ni_3Al$ alloys may have a different transition temperature 32 and/or a different melting temperature 34.

As another example, the alloy component may be formed of a titanium alloy. The relevant transition temperature 32 for the titanium alloy may be the $\beta$-transus temperature, which is the temperature above which the $\alpha$ phase (hexagonal lattice form) titanium alloy substantially transforms to a $\beta$ phase (body-centered cubic) alloy. In some examples, the $\beta$-transus temperature may be between approximately 1550° F. and approximately 1850° F. and the melting temperature of the alloy may be approximately 2900° F. Of course, the $\beta$-transus temperature and melting temperature depend on the precise composition of the alloy, and other titanium alloys may have a different transition temperature 32 and/or a different melting temperature 34.

In other embodiments, the alloy component may be formed of another alloy, such as a steel, an aluminum alloy, or the like and the transition temperature 32 and melting temperature 34 may be different than those listed above.

In some embodiments, as shown in FIG. 3A, the alloy component may be heated to a substantially uniform temperature 38 above the transition temperature 32. In other embodiments, as shown in FIG. 3B, a first portion of the alloy component may be heated to a first temperature 44 above the transition temperature 32, while a second portion of the alloy component may be heated to a second temperature 46 above the transition temperature 32. The second temperature 46 may be different than the first temperature 44. Each of the first temperature 44 and second temperature 46 may be below the melting temperature 34 of the alloy.

The heating of the alloy component may be accomplished, for example, by inductively heating the alloy component, or by heating the alloy component radiantly, e.g., in a furnace. In embodiments in which the first and second portions of the alloy component are heated to first and second temperatures, respectively, the first and second portions may be inductively heated using different magnetic field strengths. For example, in embodiments in which the alloy component comprises gas turbine engine disk 10, a first inductive heating coil may be shaped to correspond to the shape of the rim portion 12, while a second inductive heating coil may be shaped to correspond to the shape of the bore portion 16. The first and second inductive heating coils then may be driven by different voltages or currents to produce different magnetic field strengths. The different magnetic field strengths may induce different magnitudes of eddy currents in the rim portion 12 and bore portion 16, which may result in different temperatures in the rim portion 12 and bore portion 16.

As another example, the differential heating of the alloy component may be accomplished by heating the entire component in a furnace or other radiant heat source, with a portion of the component enclosed or covered in a thermally insulative material. This may result in a lower temperature in the portion of the component enclosed or covered by the thermally insulative material.

In some embodiments, heating the alloy component above the transition temperature 32 (20) may facilitate grain growth in the matrix phase, e.g., the $\gamma$-Ni phase, when the alloy component is maintained above the transition temperature 32 for a sufficient time. As described above, the transition temperature 32 may be a temperature above which the alloy is a solid solution. In some embodiments, the solid solution may be a single, substantially homogeneous phase, which may not include a second phase. In examples in which there is not a second phase present, the grains of the phase present above the transition temperature 32, e.g., the $\gamma$-Ni phase, are free to grow through diffusion. Accordingly, the time for which the alloy component is heated above the transition temperature 32 may control the extent of diffusion, and the resulting grain size. For example, if the alloy component is heated above the transition temperature 32 for only a short time, little or no grain growth may occur, while if the alloy component is heated above the transition temperature 32 for an extended period of time, the grains may grow more extensively. Control of the grain size of the matrix phase may affect the properties of the alloy component. For example, a coarse grain structure may provide greater resistance to creep and high temperature fatigue crack growth than a fine grain structure, while a fine grain structure may provide greater tensile strength than a coarse grain structure. Control of both the grain structure and the average precipitate phase domain size may combine to facilitate control of the final properties of the alloy component.

In other embodiments, such as when the alloy component comprises a titanium alloy, heating the alloy component above the transition temperature 32 may result in a crystalline phase transition, e.g., a transition from an α phase (hexagonal lattice form) titanium alloy substantially transforms to a β phase (body-centered cubic) alloy. In some embodiments, one or more elements or compounds present in the alloy may be more soluble in the crystalline phase that is present above the transition temperature 32. Thus, when the alloy is at a temperature below the transition temperature 32 the one or more elements may be present as a precipitate phase within the α phase matrix, and when the alloy is at a temperature above the transition temperature 32 the one or more elements may be substantially dissolved in the β phase matrix. In some embodiments, then, heating an alloy above a transition temperature 32 at which a crystalline phase transition occurs may have similar effects to heating an alloy above a transition temperature 32 above which the alloy forms a solid solution.

In some embodiments, the alloy component may be heated to a substantially uniform temperature 38, as shown in FIG. 3A, while in other embodiments, as shown in FIG. 3B, a first portion of the alloy component may be heated to a first temperature 44, and a second portion of the alloy component may be heated to a second temperature 46. In the embodiment illustrated in the FIG. 3A, the resulting grain structure may be substantially uniform; that is, the grains may be substantially the same size throughout the alloy component. Although the grain size may be substantially uniform, there may be some difference in grain size between the first and second portions due to the difference in time spent above the transition temperature 32 due to the first portion experiencing the first cooling rate 40 and the second portion experiencing the second cooling rate 42. For example, the grain size in the first portion may be somewhat smaller than the grain size in the second portion.

In the embodiment illustrated in the FIG. 3B, in which the first portion is heated to the first temperature 44 and the second portion is heated to the second temperature 46, the resulting grain size distributions in the first portion and the second portion may be different. For example, FIG. 3B shows that the second temperature 46 is greater than the first temperature 44, and that the second portion experiences temperatures above the transition temperature 32 for a longer time than the first portion. Due to the second temperature 46 being higher than the first temperature 44, diffusion in the second portion may be faster than diffusion in the first portion, and the grains in the second portion may grow faster than grains in the first portion. Further, similar to the embodiment illustrates in FIG. 3A, the second portion may experience temperatures above the transition temperature 32 for a longer time than the first portion, which may further increase the grain size in the second portion compared to the grain size in the first portion.

While not illustrated in FIGS. 3A and 3B, the first and second portions of the alloy component may be heated for different lengths of time in some embodiments. Heating the first and second portions for different lengths of time may be another way to control independently the matrix grain size in the first and second portions. For example, heating the second portion for a longer time than the first portion may result in coarser (larger) grains in the second portion compared to the grains in the first portion.

Once the alloy component has been heated to the desired temperature or temperatures for the desired time or times, the alloy component may be cooled. As FIGS. 2, 3A, and 3B illustrate, a first portion of the alloy component may be cooled at a first cooling rate 40 (22) and a second portion of the alloy component may be cooled at a second cooling rate 42 (24). The second cooling rate 42 may be different from the first cooling rate 40.

As the first and second portions of the alloy component are cooled, the temperatures of the portions cross the transition temperature 32. Once the temperature of a portion of the alloy component crosses the transition temperature 32, precipitate phase material may begin to precipitate out of the solid solution and form secondary and/or tertiary precipitate phase domains in the matrix phase of that portion. Formation of the secondary and/or tertiary precipitate phase domains may pin the grain size of the matrix in that portion of the alloy component, and may prevent the grain size from growing further.

As both FIGS. 3A and 3B illustrate, the cooling rate 40 that the first portion undergoes may be greater than the cooling rate 42 experienced by the second portion. In addition to affecting the time which the first portion or second portion is above the transition temperature 32, as described above, the first and second cooling rates 40 and 42 may affect the amount of time during which precipitate phase material may precipitate out of the matrix phase and the secondary and/or tertiary precipitate phase domains may grow. For example, in the illustrated embodiments, the first cooling rate 40 is greater than the second cooling rate 42, which may result in finer (smaller) precipitate phase domains in the first portion of the alloy component compared to the precipitate phase domains in the second portion of the alloy component. As described above, this may result in different material properties in the first portion and the second portion of the alloy component.

In addition to secondary precipitate phase domains forming as the first and second portions of the alloy component are cooled below transition temperature 32, tertiary precipitate phase domains may form in the first and/or second portions of the alloy component as the alloy component is cooled to a lower temperature. In some embodiments, if the cooling rate for the portion is sufficiently slow, tertiary precipitate phase domains may not form in the first portion and/or the second portion of the alloy component.

The first and second cooling rates 40 and 42 of the first and second portions may be accomplished by, for example, utilizing different cooling media for the first and second portions of the alloy component. For example, the first portion may be cooled using a first fluid having a first heat capacity and the second portion may be cooled using a second fluid having a second heat capacity. For example, the first portion, which experiences the first cooling rate 40, may be cooled by a first cooling medium, such as water or oil, which has a higher heat capacity, while the second portion, which experiences the second cooling rate 42, may be cooled by a second cooling medium, such as air, which has a lower heat capacity. In some embodiments, a cooling media shield may be provided between the first and second portions to, for example, reduce or substantially prevent exposure of the second portion of the alloy component to the water or oil and maintain the different cooling rates.

In other embodiments, the first and second portions may be cooled by the same cooling medium, but may be exposed to different flow rates of the cooling medium. For example, the first portion may be cooled by forced air, while the second portion is cooled by ambient air. In this example, the first portion will again experience a first cooling rate 40 greater than the second cooling rate 42 experienced by the second portion. In some embodiments, a cooling media shield may be provided between the first and second portions of the alloy component to prevent the forced air from contacting the second portion and increasing the second cooling rate 42 above the desired rate. In other embodiments, the second portion may be exposed to a heat source, such as induction heating or radiant heating, which slows cooling of the second portion relative to cooling of the first portion.

In other embodiments, the first portion may be cooled using a fluid, e.g., ambient air, forced air, or a liquid, while the second portion is enclosed in a thermal barrier, such as thermal insulation, which retards the second cooling rate 42 of the second portion compared to the first cooling rate 40 of the first portion.

Regardless of how the first cooling rate 40 and second cooling rate 42 are accomplished, the cooling rates 40 and 42 may be selected to result in a desired average precipitate phase domain size. For example, the first cooling rate 40 may be selected to result in relatively small precipitate phase domains, which may provide to the first portion of the alloy component high tensile strength and enhanced low temperature creep resistance. The second cooling rate 42 may be selected to result in larger average precipitate phase domains, which may provide at least one of improved elevated temperature creep resistance, improved damage tolerance, and increased resistance to dwell-fatigue to the second portion of the alloy component.

The terms "relatively small precipitate phase domains," "larger average precipitate phase domains," "high tensile strength, "enhanced low temperature creep resistance," "improved elevated temperature creep resistance," "improved damage tolerance," and "increased resistance to dwell-fatigue" may have different definitions for different alloys. For example, a high tensile strength for one alloy may not be a high tensile strength for another alloy. Similarly, a relatively small precipitate phase domain that provides certain properties for one alloy may not provide similar properties for another alloy, or a high temperature for one alloy may not be a high temperature for a second alloy.

As one example, a $\gamma$-Ni+$\gamma'$-$Ni_3Al$ processed by the techniques described in FIGS. 2, 3A, and 3B may include secondary $\gamma'$-$Ni_3Al$ precipitate phase domains and/or tertiary $\gamma'$-$Ni_3Al$ precipitate phase domains upon completion of the described heat treatment technique. In some embodiments, the tertiary $\gamma'$-$Ni_3Al$ precipitate phase domains may comprise an average diameter of between approximately 10 nanometers (nm) and approximately 50 nm (approximately 0.01 micrometer (μm) and approximately 0.05 μm), and the secondary $\gamma'$-$Ni_3Al$ precipitate phase domains may comprise an average diameter between approximately 100 nm and approximately 300 nm (approximately 0.1 μm and approximately 0.3 μm). Primary $\gamma'$-$Ni_3Al$ precipitate phase domains, which may not be present in a $\gamma$-Ni+$\gamma'$-$Ni_3Al$ alloy processed by the techniques described with reference to FIGS. 2, 3A, and 3B, may have an average diameter of approximately 1 μm to approximately 3 μm. In some embodiments, relatively small $\gamma'$-$Ni_3Al$ precipitate phase domains may refer to $\gamma'$-$Ni_3Al$ precipitate phase domains having an average diameter of less than approximately 0.1 μm, or between approximately 0.01 μm and approximately 0.03 μm, e.g., primarily tertiary $\gamma'$-$Ni_3Al$ precipitate phase domains. In some embodiments, larger $\gamma'$-$Ni_3Al$ precipitate phase domains may refer primarily to secondary $\gamma'$-$Ni_3Al$ precipitate phase domains. The portion of the alloy that includes $\gamma'$-$Ni_3Al$ precipitate phase domains of a larger average size may still include some tertiary $\gamma'$-$Ni_3Al$ precipitate phase domains.

In some embodiments, low temperatures may refer to temperatures below approximately 700° C. That is, enhanced low temperature creep resistance may refer to enhanced creep resistance at temperatures below approximately 700° C., while improved elevated temperature creep resistance may refer to improved creep resistance at temperatures above approximately 700° C. Again, the temperatures that are considered "low" or "high" may differ for different alloys, and the properties that are considered "improved" or "enhanced" may also differ for different alloys.

The first and second cooling rates 40 and 42 that result in the desired precipitate phase domain sizes may vary depending on the composition of the alloy. In embodiments in which the alloy component comprises a $\gamma$-Ni+$\gamma'$-$Ni_3Al$ alloy, the first cooling rate 40, which results in small precipitate phase domains (e.g., an average diameter of less than approximately 0.1 μm) may be greater than or equal to approximately 200° F. per minute (° F./min), such as, for example, approximately 300° F./min. In those same embodiments, the second cooling rate 42, which results in larger precipitate phase domains (e.g., an average diameter of greater than approximately 0.1 μm) may be less than or equal to approximately 120° F./min, such as, for example, approximately 75° F./min. Other cooling rates may be useful in other embodiments. For example, the first and second cooling rates may be different than those listed above when a different precipitate phase domain size is desired, or when the alloy component comprises a different $\gamma$-Ni+$\gamma'$-$Ni_3Al$ alloy composition or a different alloy altogether. In some embodiments, cooling rate as low as approximately 5° F./min may be used, which may result in precipitate phase domains having an average size of approximately 2 μm.

In addition to the cooling rate, the average precipitate phase domain size may depend on the solution temperature. For example, the average diameter of secondary precipitate phase domains may depend on the solution temperature, and in some embodiments, may depend on the solution temperature to a greater extent than the cooling rate. In some embodiments, if the cooling rate is sufficiently slow, tertiary precipitate phase domains may not even form.

As described briefly above, in some embodiments the alloy component may be a gas turbine engine disk 10. In these embodiments, the first portion of the alloy component may be the hub portion 16 and the second portion of the alloy component may be the rim portion 12. In some embodiments, it may be desired for the hub portion 16 to include precipitate phase domains having a smaller average diameter and the rim portion 12 to include precipitate phase domains having a larger average diameter. For example, a hub portion 16 having smaller precipitate phase domains may possess desirable low temperature strength and creep resistance, while a rim portion 12 having larger precipitate phase domains may possess improved elevated temperature creep resistance, improved damage tolerance, and improved resistance to dwell-fatigue.

Figure 4:
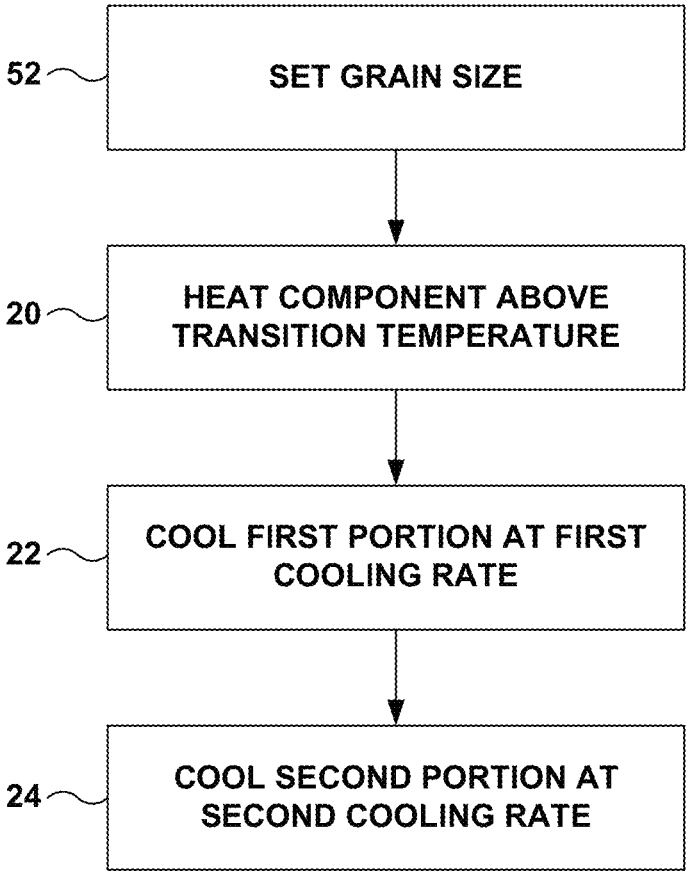
FIG. 4 is a flow diagram illustrating another example technique of heat treating an alloy component to produce a first average precipitate phase domain size in a first portion of the alloy component and a second average precipitate phase domain size in a second portion of the alloy component.

FIG. 4 is a flow chart illustrating another example technique of forming an alloy component with a first average precipitate phase domain size in a first portion of an alloy component and a second average precipitate phase domain size in a second portion of the alloy component. The technique may be similar in certain aspects to the technique described with reference to FIGS. 2, 3A, and 3B. However, prior to heating the alloy component above the transition temperature 32 of the alloy (20), the grain structure may be pre-conditioned to influence grain growth during heat treatment (52).

The grain structure of the alloy component may be pre-conditioned by, for example, forging the alloy component to provide desired uniform or non-uniform grain size or disposition for improved grain growth during heating above the transition temperature 32. As another example, the grain structure of the alloy component may be pre-conditioned by including an intentional alloying addition or secondary phase in the alloy that segregates into domains within the matrix and is substantially insoluble in the matrix, even at temperatures above the transition temperature 32. In this case, when the alloy component is heated above the transition temperature 32, the secondary phase domains may not dissolve in the matrix, and may continue to be distinct domains. The presence of the secondary domains may prevent grain growth of the matrix grains from occurring, even at temperatures above the transition temperature 32.

Once the grain structure of the matrix is pre-conditioned, the alloy component may be heated above the transition temperature 32 (20). In some embodiments, this may be done to dissolve into the matrix any precipitate phase domains (e.g., primary, secondary, and/or tertiary precipitate phase domains) present in the alloy component. In some embodiments, the precipitate phase domain size present in the alloy component may be larger than is desired. For example, the alloy component may have precipitate phase domains present in the alloy when purchased from a supplier. The average precipitate phase domain size in at least a portion of the alloy component may be larger than is desired, and heating the alloy component above the transition temperature 32 (20) may dissolve substantially all of the precipitate phase into the matrix phase and allow reformation and growth of precipitate phase domains when the alloy component is cooled.

In some embodiments, the alloy component may be heated to a temperature above the transition temperature 32 for a time sufficient to dissolve in the matrix phase the substantially all of the precipitate phase. In other embodiments, the alloy component may be heated to a temperature above the transition temperature 32 for a time sufficient to dissolve in the matrix phase only a portion of the precipitate phase. In either case, the alloy component then may be cooled to a temperature below the transition temperature 32. In the technique illustrated in FIG. 4, a first portion of the alloy component is cooled at a first cooling rate (22) and a second portion of the alloy component is cooled at a second cooling rate (22). As described above with reference to FIGS. 2, 3A, and 3B, approximately when the temperatures of the first and second portions cross the transition temperature 32, respectively, precipitate in the respective domains begins to precipitate out of the solid solution and form secondary and/or tertiary precipitate phase domains in the matrix phase.

In some embodiments, the first cooling rate may be greater than the second cooling rate. In addition to affecting the time which the first portion or second portion is above the transition temperature 32, as described above, the first and second cooling rates may affect the amount of time during which precipitate may precipitate out of the matrix phase and the secondary and/or tertiary precipitate phase domains may grow. For example, the first cooling rate may be greater than the second cooling rate, which may result in, on average, smaller precipitate phase domains in the first portion of the alloy component compared to the precipitate phase domains in the second portion of the alloy component. As described above, this may result in different material properties in the first portion and the second portion of the alloy component.

In some embodiments, the first and second cooling rates may be accomplished by utilizing different cooling media for the first and second portions of the alloy component. For example, the first portion may be cooled using a first cooling medium having a first heat capacity and the second portion may be cooled using a second cooling medium having a second heat capacity. In other embodiments, the first and second portions may be cooled by the same cooling medium, but may be exposed to different flow rates of the cooling medium. In other embodiments, the first portion may be cooled using a first cooling medium, e.g., ambient air, forced air, or another fluid, while the second portion is enclosed in a thermal barrier, such as thermal insulation, which retards the second cooling rate compared to the first cooling rate.

Regardless of how the first and second cooling rates are accomplished, the cooling rates may be selected to result in a desired average precipitate phase domain size in the respective portions of the alloy component. For example, the first cooling rate may be selected to result in precipitate phase domains having a relatively small average diameter, which may provide high tensile strength and high creep resistance at relatively low temperatures to the first portion of the alloy component. Continuing the example, the second cooling rate may be selected to result in precipitate phase domains having a larger average size, which may provide at least one of improved elevated temperature creep resistance, improved damage tolerance, and increased resistance to dwell-fatigue to the second portion of the alloy component.

The solution heat treatment temperatures and first and second cooling rates that result in the desired average precipitate phase domain sizes may vary depending on the composition of the alloy. In embodiments in which the alloy component comprises a $\gamma$-Ni+$\gamma'$-$Ni_3Al$ alloy, the first cooling rate, which results in smaller average precipitate phase domains (e.g., an average diameter less than approximately 0.1 μm) may be greater than or equal to approximately 200° F. per minute (° F./min), such as, for example, approximately 300° F./min. In those same embodiments, the second cooling rate, which results in larger precipitate phase domains (e.g., an average diameter greater than approximately 0.1 μm) may be less than or equal to approximately 120° F./min, such as, for example, approximately 75° F./min. Other cooling rates may be useful in other embodiments. For example, the first and second cooling rates may be different than those listed above when a different precipitate phase domain size is desired, or when the alloy component comprises a different $\gamma$-Ni+$\gamma'$-$Ni_3Al$ alloy composition or a different alloy altogether.

Figure 5:
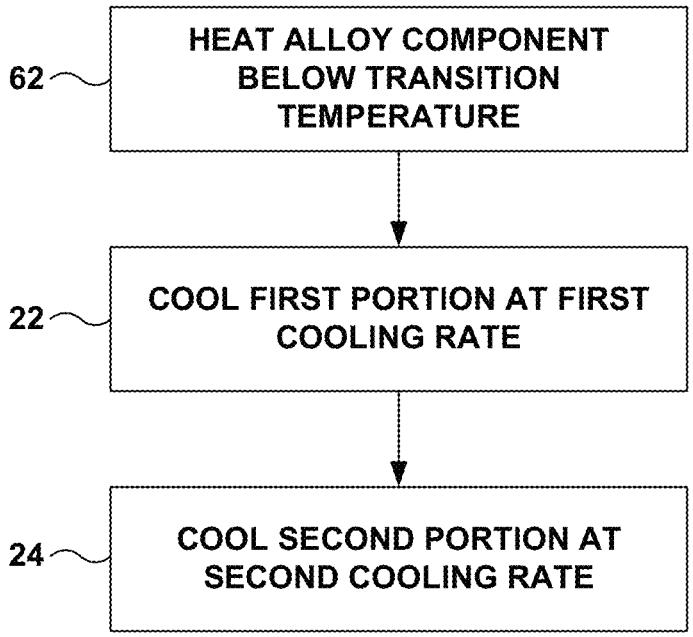
FIG. 5 is a flow diagram illustrating another example technique of heat-treating an alloy component to produce a first average precipitate phase domain size in a first portion of the alloy component and a second average precipitate phase domain size in a second portion of the alloy component.

FIG. 5 is a flow diagram illustrating another example technique of forming an alloy component with a first average precipitate phase domain size in a first portion of the component and a second average precipitate phase domain size in a second portion of the component. The technique illustrated in FIG. 5 will be described with further reference to the time-temperature diagrams illustrated in FIGS. 6A and 6B. In the embodiments illustrated in FIGS. 5, 6A, and 6B, the alloy component may include precipitate phase domains prior to undergoing the heat treatment technique. First, the alloy component is heated to a temperature below a transition temperature 32 of the alloy (62). For example, in embodiments in which the alloy component is formed of a γ-Ni+γ'-$Ni_3Al$ alloy, the alloy component may be heated to a temperature approximately 75° F. to approximately 150° F. below the γ'-$Ni_3Al$ solvus temperature. As another example, in embodiments in which the alloy component is formed of a titanium alloy, the alloy component may be heated to a temperature approximately 50° F. to approximately 100° F. below the β-transus temperature.

Figure 6A:
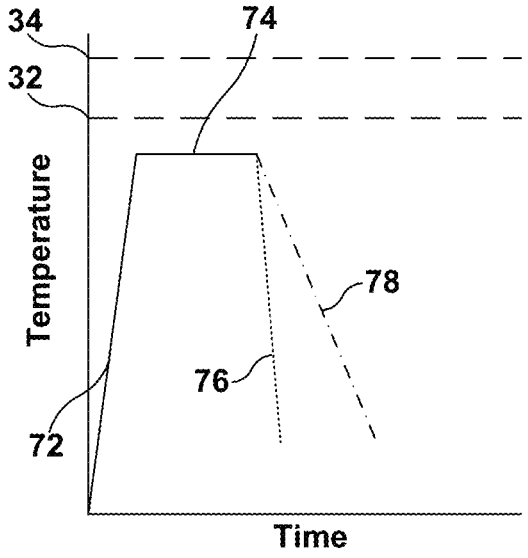
FIGS. 6A and 6B are time-temperature diagrams illustrating example heat treatments to which an alloy component may be exposed.
Figure 6B:
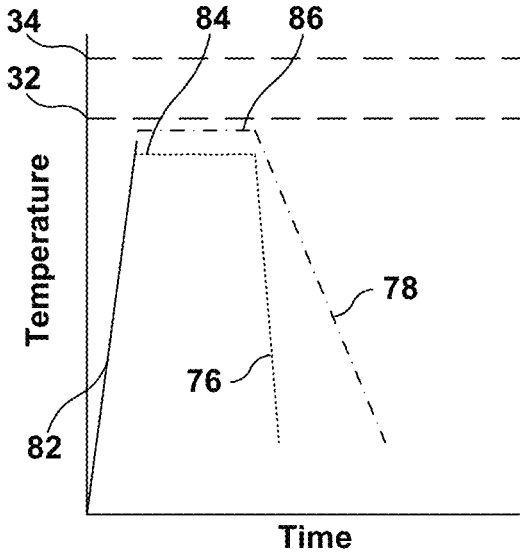

In some embodiments, as illustrated in FIG. 6A, the alloy component may be heated (represented by portion 72 of the time-temperature curve) to a substantially uniform temperature 74 below the transition temperature 32 of the alloy. In other embodiments, as illustrated in FIG. 6B, a first portion of the alloy component may be heated (represented by portion 82 of the time-temperature curve) to first temperature 84 below the transition temperature 32 and a second portion of the alloy component may be heated to a second temperature 86 below the transition temperature 32. The differential heating of the first and second portions of the alloy component may contribute to formation of a first average precipitate phase domain size in the first portion of the alloy component and a second average precipitate phase domain size in the second portion of the alloy component. For example, the heat treatment below transition temperature 32 may result in dissolution of at least some of the precipitate phase domains present in the alloy component. In particular, heat treatment below transition temperature 32 may dissolve some of the precipitate phase domains present in the alloy component, while leaving some of the precipitate phase domains present in the alloy component undissolved. The undissolved precipitate phase domains are referred to as primary precipitate phase domains, as described above. The volume fraction of the primary precipitates that remain undissolved in the first portion and the second portion may be controlled by the temperature at which the first portion and the second portion, respectively, are heat treated. In addition to remaining substantially undissolved, the primary precipitate phase domains may coarsen during the heat treatment below the transition temperature. The size to which the primary precipitate domains coarsen may be controlled by the duration of the heat treatment at this temperature.

In some embodiments, the first temperature 84 may be sufficiently low so that substantially no precipitate phase domain dissolution or primary precipitate phase domain coarsening occurs. That is, in some embodiments only a portion of the alloy component may be heated to a temperature sufficiently high to facilitate dissolution of at least some of the precipitate phase domains and/or primary precipitate phase domain coarsening. In some examples, the alloy component may already include some amount of precipitate phase domains (e.g., primary, secondary, and/or tertiary precipitate phase domains) throughout the component, and an average precipitate phase domain size different than that already present may be desired in only a portion of the component. Thus, in some embodiments only the portion of the component in which a different average precipitate phase domain size is desired may be heated to a temperature sufficient to dissolve at least some of the precipitate phase domains and/or coarsen at least some of the primary precipitate phase domains in that portion. As described above, heating of the first and second portions to first and second temperatures 84 and 86, respectively, may be accomplished in some embodiments by inductively heating the first and second portions using two inductive coils driven at different voltages or currents. In other embodiments, heating of the first and second portions to first and second temperatures 84 and 86, respectively, may be accomplished by radiantly heating the alloy component and thermally insulating the portion that is to be heated to the lower temperature, e.g., the first portion which is heated to the first temperature 84.

Turning back to embodiments in which substantially all of the alloy component is heated to a temperature which facilitates dissolution of at least some of the precipitate phase domains, primary precipitate phase domain coarsening, and secondary and/or tertiary precipitate phase domain growth upon subsequent cooling, a first portion of the alloy component may be cooled at a first cooling rate 76 (22) and a second portion of the alloy component may be cooled at a second cooling rate 78 (24). In some embodiments, as illustrated in FIGS. 6A and 6B, the first cooling rate 76 may be greater than the second cooling rate 78. In embodiments such as those illustrated in FIG. 6A, the use of first and second cooling rates 76 and 78 alone may facilitate control of the growth of secondary and/or tertiary precipitate phase domains in the first and second portions of the alloy component. In embodiments such as those illustrated in FIG. 6B, the use of the first and second cooling rates 76 and 78 may facilitate control of the growth of secondary and/or tertiary precipitate phase domains in the first and second portions of the alloy component, in addition to the control of precipitate phase dissolution and primary precipitate phase domain coarsening afforded by heating of the first and second portions to first and second temperatures 84 and 86, respectively. For example, the first cooling rate 76 may be greater than the second cooling rate 78, which may result in a shorter time during which precipitate phase domain growth may occur, and lead to smaller secondary and/or tertiary precipitate phase domains in the first portion of the alloy component compared to the secondary and/or tertiary precipitate phase domains in the second portion of the alloy component. As described above, this may result in different material properties in the first portion and the second portion of the alloy component.

In some embodiments, the first and second cooling rates 76 and 78 may be accomplished by utilizing different cooling media for the first and second portions of the alloy component. For example, the first portion may be cooled using a first fluid having a first heat capacity and the second portion may be cooled using a second fluid having a second heat capacity. In other embodiments, the first and second portions may be cooled by the same fluid, but may be exposed to different flow rates of the fluid. In other embodiments, the first portion may be cooled using a fluid, e.g., ambient air, forced air, or a liquid, while the second portion is enclosed in a thermal barrier, such as thermal insulation, which retards the second cooling rate 78 compared to the first cooling rate 76.

Regardless of how the first and second cooling rates 76 and 78 are accomplished, the cooling rates 76 and 78 may be selected to result in a desired average precipitate phase domain size. For example, the first cooling rate 76 may be selected to result in precipitate phase domains having a relatively small average diameter, which may provide high tensile strength and high creep resistance at relatively low temperatures to the first portion of the alloy component. Continuing the example, the second cooling rate 78 may be selected to result in precipitate phase domains having a larger average diameter, which may provide at least one of improved elevated temperature creep resistance, improved damage tolerance, and increased resistance to dwell-fatigue to the second portion of the alloy component.

The first and second cooling rates 76 and 78 and the optional first and second temperatures 84 and 86 that result in the desired average precipitate phase domain sizes may vary depending on the composition of the alloy. In embodiments in which the alloy component comprises a γ-Ni+γ'-$Ni_3Al$ alloy, the first cooling rate 76, which results in small secondary and/or tertiary precipitate phase domains (e.g., less than approximately 0.1 μm) may be greater than or equal to approximately 200° F. per minute (° F./min), such as, for example, approximately 300° F./min. In those same embodiments, the second cooling rate 78, which results in larger secondary and/or tertiary precipitate phase domains (e.g., greater than approximately 0.1 μm) may be less than or equal to approximately 120° F./min, such as, for example, approximately 75° F./min. Other cooling rates may be useful in other embodiments, for example, as low as approximately 5° F./min or lower. For example, the first and second cooling rates may be different than those listed above when a different average precipitate phase domain size is desired, or when the alloy component comprises a different γ-Ni+γ'-$Ni_3Al$ alloy composition or a different alloy altogether.

Figure 7:
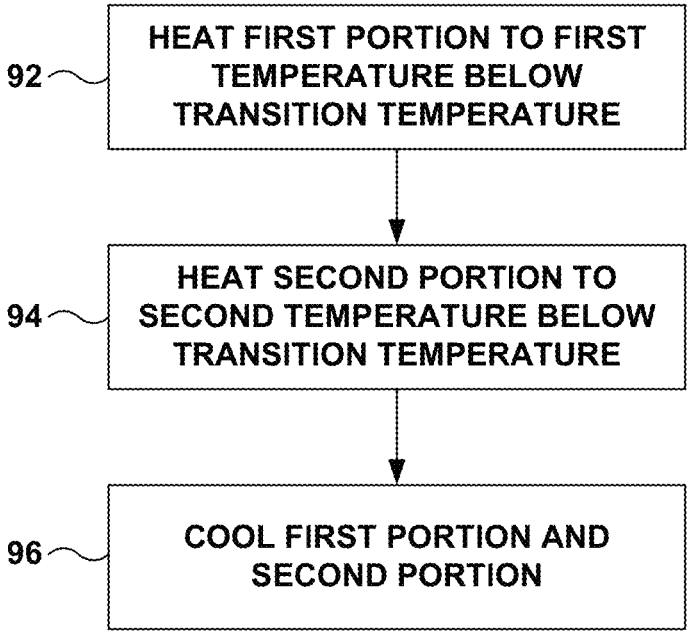
FIG. 7 is a flow diagram illustrating an example technique of heat-treating a first portion of an alloy component at a first temperature and a second portion of an alloy component at a second temperature to produce a first average precipitate phase domain size in the first portion and a second average precipitate phase domain size in the second portion.
Figure 8:
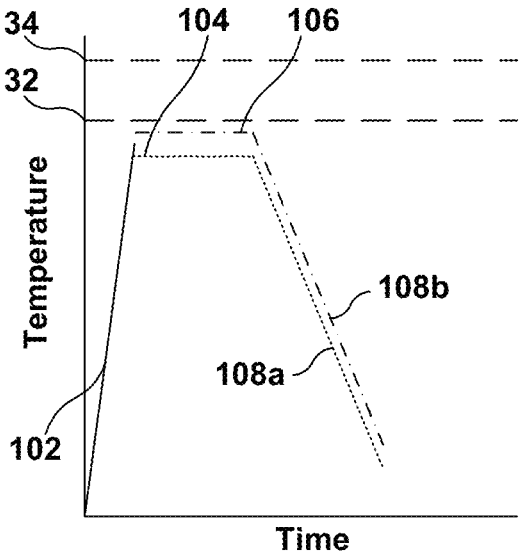
FIG. 8 is a time-temperature diagram illustrating example heat treatment to which an alloy component may be exposed.

FIG. 7 is a flow diagram illustrating another example of a technique that may be performed to produce an alloy component having a first average precipitate phase domain size in a first portion of the alloy component and a second average precipitate phase domain size in a second portion of the alloy component. FIG. 8 is a time-temperature diagram that further illustrates the technique of FIG. 7.

In the embodiments illustrated in FIGS. 7 and 8, the alloy component may include precipitate phase domains prior to undergoing the heat treatment technique. First, a first portion of the alloy component may be heated 102 to a first temperature 104 below a transition temperature 32 of the alloy (92) and a second portion of the alloy component may be heated 102 to a second temperature 106 below the transition temperature 32 of the alloy (94). The first temperature 104 may be different than the second temperature 106. For example, in embodiments in which the alloy component is formed of a γ-Ni+γ'-$Ni_3Al$ alloy, the first portion may be heated to a first temperature 104 between approximately 75° F. and approximately 150° F. below the γ'-$Ni_3Al$ solvus temperature. Similarly, the second portion may be heated to a second temperature 106 between approximately 75° F. and approximately 150° F. below the γ'-$Ni_3Al$ solvus temperature. As another example, in embodiments in which the alloy component is formed of a titanium alloy, the first and second portions may be heated to a different temperatures, each temperature between approximately 50° F. and approximately 100° F. below the β-transus temperature.

The differential heating of the first and second portions of the alloy component may contribute to formation of a first average precipitate phase domain size in the first portion of the alloy component and a second average precipitate phase domain size in the second portion of the alloy component. For example, the heat treatment below transition temperature 32 may result in dissolution of at least some of the precipitate phase domains present in the alloy component. In particular, heat treatment below transition temperature 32 may dissolve some of the precipitate phase domains present in the alloy component, while leaving some of the precipitate phase domains present in the alloy component undissolved. The undissolved precipitate phase domains are referred to as primary precipitate phase domains, as described above. The volume fraction of the primary precipitates that remain undissolved in the first portion and the second portion may be controlled by the temperature at which the first portion and the second portion, respectively, are heat treated. In addition to remaining substantially undissolved, the primary precipitate phase domains may coarsen during the heat treatment below the transition temperature. The size to which the primary precipitate domains coarsen may be controlled by the duration of the heat treatment at this temperature.

In some embodiments, the first temperature 104 may be sufficiently low so that substantially no precipitate phase domain dissolution or primary precipitate phase domain coarsening occurs. That is, in some embodiments only a portion of the alloy component may be heated to a temperature sufficiently high to facilitate dissolution of at least some of the precipitate phase domains and/or primary precipitate phase domain coarsening. In some examples, the alloy component may already include some amount of precipitate phase domains (e.g., primary, secondary, and/or tertiary precipitate phase domains) throughout the component, and an average precipitate phase domain size different than that already present may be desired in only a portion of the component. Thus, in some embodiments only the portion of the component in which a different average precipitate phase domain size is desired may be heated to a temperature sufficient to dissolve at least some of the precipitate phase domains and/or coarsen at least some of the primary precipitate phase domains in that portion. As described above, heating of the first and second portions to first and second temperatures 104 and 106, respectively, may be accomplished in some embodiments by inductively heating the first and second portions using two inductive coils driven at different voltages or currents. In other embodiments, heating of the first and second portions to first and second temperatures 104 and 106, respectively, may be accomplished by radiantly heating the alloy component and thermally insulating the portion that is to be heated to the lower temperature, e.g., the first portion which is heated to the first temperature 104.

First temperature 104 and second temperature 106 may also affect the formation and growth of secondary precipitate phase domains and tertiary precipitate phase domains upon cooling of first portion and second portion, respectively. Precipitation of precipitate phase domains out of the matrix phase may begin at a somewhat lower temperature than the heat treatment temperature. For example, precipitation of precipitate phase domains may begin at a temperature approximately 30° F. below the heat treatment temperature. A lower heat treatment temperature (e.g., first temperature 104 compared to second temperature 106) may lead to a lower temperature at which precipitation begins, and thus a smaller ranger of temperatures over which precipitate phase domain growth may occur during cooling, because precipitate phase domains growth substantially does not occur below a certain temperature. Thus, a lower sub-transition heat treatment temperature may also affect the average size of secondary and tertiary precipitate phase domains.

In some embodiments, as discussed with reference to FIGS. 5 and 6B, first and second portions of an alloy component may be heated to first and second temperatures 84 and 86 and cooled at first and second cooling rates 76 and 78, respectively. In this way, both the heat treatment temperatures and cooling rates may affect the formation of precipitate phase domains. In other embodiments, as illustrated in FIGS. 7 and 8, the first and second portions of the alloy component may be cooled at substantially the same cooling rate 108 (96). Although the cooling rate 108 may be substantially similar, the temperature of the first and second portions at any particular time may be different, because the first and second portions are being cooled from different initial temperatures. This is represented in FIG. 8 by first cooling curve 108*a* for the first portion of the alloy component and second cooling curve 108*b*.

Even though the cooling rate 108 of the first and second portions may be substantially similar, the formation of secondary and tertiary precipitate phase domains during cooling may be different in the first and second portions. As described above, the precipitation of secondary precipitate phase domains may begin at a temperature somewhat below the heat treatment temperature. Thus, in the illustrated embodiment, secondary precipitate phase domain formation may begin at a higher temperature in the second portion, which is heated to second temperature 106, than in the first portion, which is heated to first temperature 104. This may lead to coarser secondary precipitate phase domains in the second portion and finer precipitate phase domains in the first portion. A similar effect may be observed with respect to tertiary phase domain formation in the first and second portions. In some embodiments, if first temperature 104 is sufficiently low, tertiary precipitate phase domains may not even form in the first portion.

Figure 9:
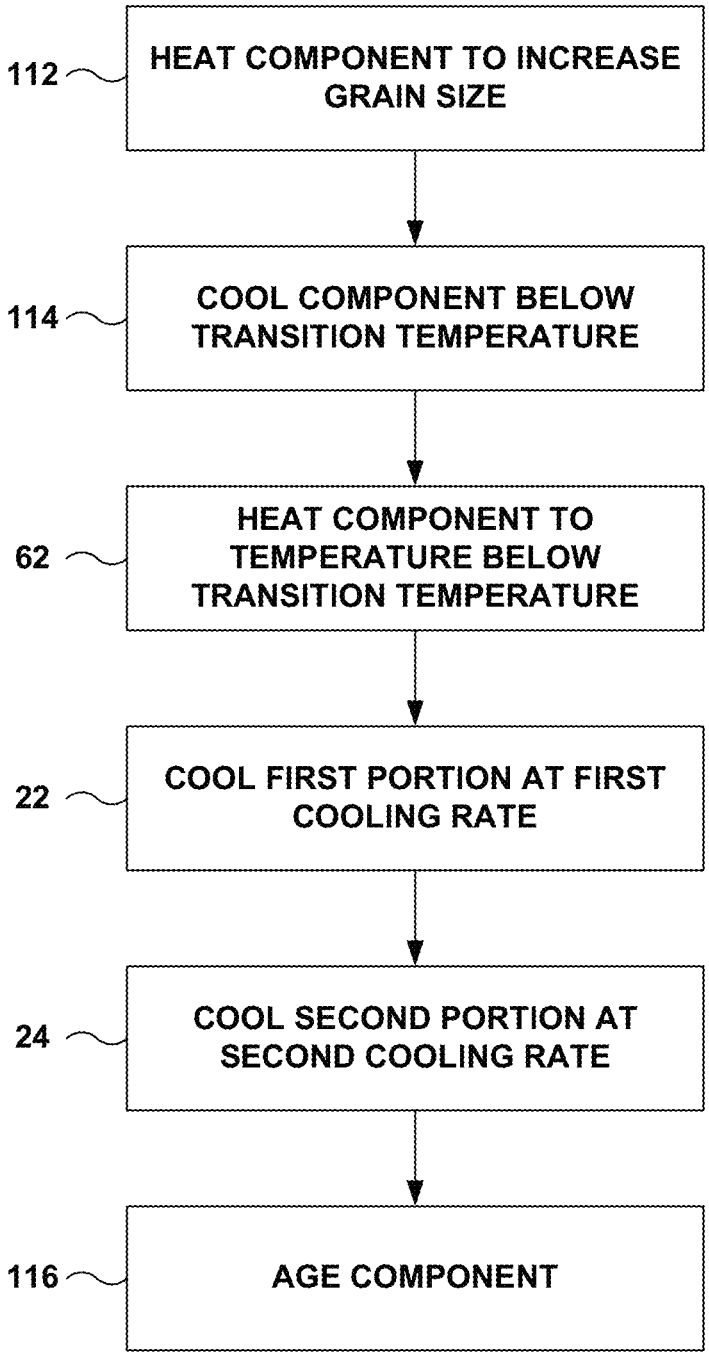
FIG. 9 is a flow diagram illustrating another example technique of heat-treating an alloy component to produce a first average precipitate phase domain size in a first portion of the alloy component and a second average precipitate phase domain size in a second portion of the alloy component.
Figure 10A:
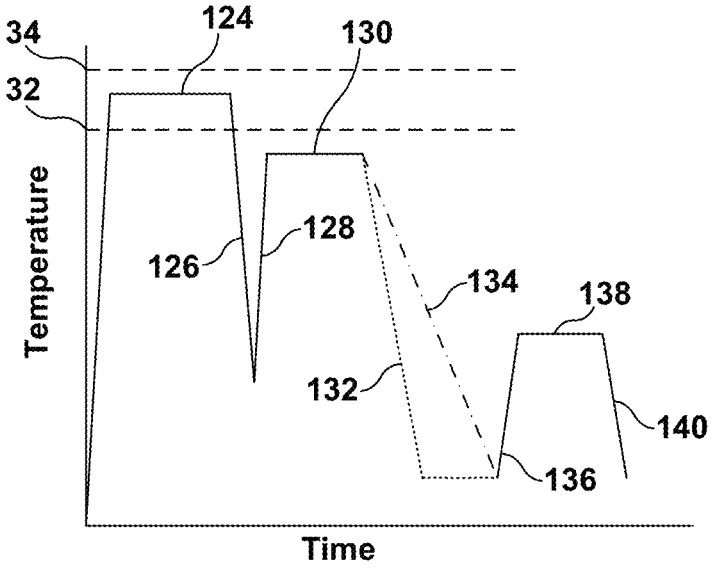
FIGS. 10A and 10B are time-temperature diagrams illustrating example heat treatments to which an alloy component may be exposed.
Figure 10B:
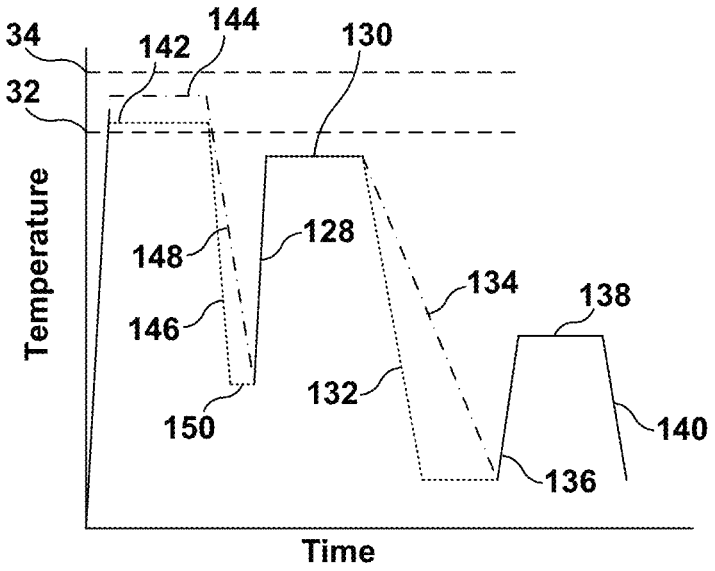

FIG. 9 is a flow diagram illustrating an example technique that may be performed to manufacture an alloy component with controlled matrix grain size and a first average precipitate phase domain size in a first portion of the alloy component and a second average precipitate phase domain size in a second portion of the alloy component. FIGS. 10A and 10B show two exemplary time-temperature diagrams that further illustrate the technique of FIG. 9.

In the technique of FIG. 9, the alloy component is first heated above the transition temperature 32 to increase the grain size of the matrix (112). As described above with respect to FIGS. 2, 3A, and 3B, heating the component above the transition temperature 32 may dissolve substantially all of any precipitate phase domains present in the alloy component, and may facilitate grain growth of the matrix. Once the desired matrix grain size has been achieved, the alloy component may be cooled below the transition temperature 32 (114), at which time secondary and/or tertiary precipitate phase domains may begin to form and the grain size of the matrix may be pinned. Next, the alloy component may be heated to a temperature below the transition temperature 32 (62), which may facilitate dissolution of at least some of the precipitate phase domains, leaving primary precipitate phase domains, which may coarsen during the heat treatment at this temperature, as described with respect to FIGS. 5, 6A, and 6B. Finally, a first portion of the alloy component may be cooled at a first rate (22) and a second portion of the alloy component may be cooled at a second rate (24). The first and second cooling rates may be different, and may result in formation of secondary and/or tertiary precipitate phase domains of a first average size in the first portion of the alloy component and formation of precipitate phase domains of a second average size in the second portion of the alloy component. As described above, the first average precipitate phase domain size may be different than the second average precipitate phase domain size.

In some embodiments, the technique illustrated in FIG. 9 may include heating the alloy component to a substantially uniform temperature 124 above the transition temperature 32, as illustrated in FIG. 10A. The alloy component may be maintained at this temperature for a time sufficient to allow grain growth to produce the desired matrix grain size (112), and the time for which the alloy component is heated above the transition temperature 32 may depend on the desired matrix grain size. Once the desired matrix grain size has been achieved, the alloy component may be cooled below the transition temperature 32 (114), which is represented in FIG. 10A as portion 126 of the time-temperature curve.

In some embodiments, as illustrated in FIG. 10A, the alloy component may be cooled to a sufficiently low temperature that precipitate phase domain growth is substantially stopped. The alloy component then may be heated to a temperature 130 below the transition temperature 32 to facilitate dissolution of at least some of the precipitate phase domains and coarsening of the primary precipitate phase domains (62). In other embodiments, the alloy component may not be cooled to such a low temperature, and may instead be cooled directly to the temperature 130 that facilitates dissolution of at least some of the precipitate phase domains and coarsening of the primary precipitate phase domains.

While FIG. 10A illustrates the alloy component being heated to a substantially uniform temperature 130 below the transition temperature 32, in other embodiments, as described above with reference to FIGS. 6B, 7, and 8, a first portion of the alloy component may be heated to a first temperature below the transition temperature 32 and a second portion of the alloy component may be heated to a second temperature below the transition temperature 32. Heating the alloy component in this manner may allow further control of the average precipitate phase domain size in the first and second portions of the alloy component, as described above with respect to FIGS. 5, 6A, 6B, 7, and 8.

In any case, the alloy component may be maintained at the substantially uniform temperature 130 or the first and second temperatures for a sufficient amount of time to allow dissolution of at least some of the precipitate phase domains and coarsening of the primary precipitate phase domains. In some examples, when different precipitate phase domain sizes are desired in the first and second portions of the alloy component, the first and second portions may be heated for different lengths of time. For example, the first and second portions may be heated to a substantially uniform temperature initially, and the second portion may be maintained at this temperature for a longer time, while the first portion is cooled to a temperature that quenches primary precipitate phase domain coarsening. This may be accomplished by, for example, heating the first and second portions with separately controllable inductive heating coils. As another example, the first and second portion may be heated to first and second temperatures, and may also be heated for different lengths of time. This may lead to a different volume fraction of primary precipitate phase domains and different average sizes of the primary precipitate phase domains in the first and second portions. For example, the second portion may be heated to a higher temperature than the first portion, and may also be heated for a longer time than the first portion.

Once the desired primary precipitate phase domain coarsening has occurred, a first portion of the alloy component may be cooled at a first cooling rate 132 (22) and a second portion of the alloy component may be cooled at a second cooling rate 134 (24). As described in further detail above, the first and second cooling rates 132 and 134 may facilitate substantially independent control over the secondary and/or tertiary precipitate phase domain sizes in the first and second portions of the alloy component. For example, the first cooling rate 132 is greater than the second cooling rate 134, and may result in the formation of smaller secondary and/or tertiary precipitate phase domains in the first portion of the alloy component than in the second portion of the alloy component.

As described above, the first and second cooling rates 132 and 134 may be selected to result in a desired average precipitate phase domain size in the first and second portions of the alloy component. For example, the first cooling rate 132 may be selected to result in precipitate phase domains having a relatively small average diameter, which may provide high tensile strength and high creep resistance at relatively low temperatures to the first portion of the alloy component. Continuing the example, the second cooling rate 134 may be selected to result in precipitate phase domains having a larger average diameter, which may provide at least one of improved elevated temperature creep resistance, improved damage tolerance, and increased resistance to dwell-fatigue to the second portion of the alloy component. As one example, the alloy component may be a turbine disk 10, and the first portion may be the bore portion 16 of the disk 10, while the second portion may be the rim portion 12 of the disk 10. The first and second cooling rates 132 and 134 then may result in precipitate phase domains having a smaller average diameter in the bore portion 16 of the disk 10 and precipitate phase domains having a larger average diameter in the rim portion 12 of the disk 10. This may provide higher tensile strength and creep resistance at relatively low temperatures to the bore of the disk and improved elevated temperature creep resistance, improved damage tolerance, and increased resistance to dwell-fatigue to the rim of the disk.

The first and second cooling rates 132 and 134 and the temperatures to which the first and second portions are heated, which result in the desired average precipitate phase domain sizes, may vary depending on the composition of the alloy. In embodiments in which the alloy component comprises a $\gamma$-Ni+$\gamma'$-$Ni_3Al$ alloy, the first cooling rate 132, which may result in small secondary and/or tertiary precipitate phase domains (e.g., an average diameter of less than approximately 0.1 μm) may be greater than or equal to approximately 200° F. per minute (° F./min), such as, for example, approximately 300° F./min. In those same embodiments, the second cooling rate 134, which results in larger secondary and/or tertiary precipitate phase domains (e.g., an average diameter of greater than approximately 0.1 μm) may be less than or equal to approximately 120° F./min, such as, for example, approximately 75° F./min. Other cooling rates may be useful in other embodiments, such as, for example, 5° F./min or lower. For example, the first and second cooling rates may be different than those listed above when a different average precipitate phase domain size is desired, or when the alloy component comprises a different $\gamma$-Ni+$\gamma'$-$Ni_3Al$ alloy composition or a different alloy altogether.

In other embodiments, as illustrated in FIG. 10B, the technique illustrated in FIG. 9 may include heating a first portion of the alloy component to a first temperature 136 above the transition temperature 32 of the alloy and heating a second portion of the alloy component to a second temperature 138 above the transition temperature 32. This differential heating of the first and second portions of the alloy component may result in different matrix grain growth rates in the first and second portions of the alloy. For example, the grain growth rate in the second portion of the alloy may be greater than the grain growth rate in the first portion of the alloy due to the higher temperature 138 in the second portion of the alloy. The first and second portions of the alloy may be heated to the first and second temperatures 136 and 138 above the transition temperature 32 for times sufficient to facilitate the desired matrix grain growth in the first and second portions (112). In some embodiments, as illustrated in FIG. 10B, the first and second portions may be heated for approximately the same time, while in other embodiments, the first and second portions may be heated above the transition temperature 32 for different amounts of time to further control the matrix grain sizes in the first and second portions of the alloy component. The different heating times may be accomplished by, for example, heating the first and second portions with two different inductive coils, and driving one of the coils for a longer time than the other coil. In yet other embodiments, the first and second portions may be heated to a substantially uniform temperature, but may be heated for different lengths of time.

Regardless of the how the heating of the first and second portions is accomplished, once the desired grain growth has occurred, the first and second portions are cooled below the transition temperature 32 (114) to begin formation of the secondary and/or tertiary precipitate phase domains and pin the grain size of the first and second portions. As illustrated in FIG. 10B, the first and second portions may be cooled at first and second cooling rates 140 and 144, respectively. This may result in formation of different average precipitate phase domain sizes in the first and second portions of the alloy component, as described above. In other embodiments, the first and second portions may be cooled to a temperature below the transition temperature at substantially the same cooling rate, which may result in formation of substantially uniformly sized precipitate phase domains throughout the alloy component.

In some embodiments, as illustrated in FIG. 10B, the alloy component may be cooled to a temperature 144 at which precipitate phase domain growth is substantially arrested. The alloy component then may be heated 128 to a temperature 130 below the transition temperature 32 to facilitate dissolution of at least some of the precipitate phase domains and coarsening of primary precipitate phase domains. In other embodiments, the alloy component may be cooled directly to the temperature 130 that facilitates dissolution of at least some of the precipitate phase domains and coarsening of primary precipitate phase domains. In these embodiments, the alloy component may be cooled at a first and second rate 140 and 142, or may be cooled at a substantially uniform rate.

While FIG. 10B illustrates the alloy component being heated to a substantially uniform temperature 130 below the transition temperature 32, in other embodiments, as described above with reference to FIGS. 6B, 7, and 8, a first portion of the alloy component may be heated to a first temperature below the transition temperature 32 and a second portion of the alloy component may be heated to a second temperature below the transition temperature 32. Heating the alloy component in this manner may allow further control of the precipitate phase domain size and the precipitate phase volume fraction in the first and second portions of the alloy component.

In some embodiments, the first and second portions which are heated to first and second temperatures 136 and 138, respectively, may correspond to the first and second portions that are heated to first and second temperatures below the transition temperature 32. That is, in some embodiments, the portion of the alloy component that is heat treated to result in smaller matrix grain sizes also may be heat treated to result in smaller average precipitate phase domains. Similarly, in some embodiments, the portion of the alloy component that is heat treated to result in larger matrix grain sizes also may be heat treated to result in larger average precipitate phase domains.

In other examples, the first and second portions of the alloy component that are heated to the first and second temperatures 136 and 138, respectively to result in different matrix grain sizes and the first and second portions of the component that are heated to different temperatures below the transition temperature 32 to result in different average precipitate phase domain sizes may not correspond to each other. In other words, a first portion of the alloy component may be processed to result in a first average precipitate phase domain size and a second portion of the alloy component may be processed to result in a second average precipitate phase domain size. A third portion of the alloy component may be processed to result in a first matrix grain size and a fourth portion of the alloy component may be processed to result in a second matrix grain size. The third portion may correspond to the first portion, the second portion, or neither portion. Similarly, the fourth portion may correspond to the first portion, the second portion, or neither portion. As one example, the third portion may correspond to a portion of the alloy component that includes a fraction of the first portion and a fraction of the second portion, and the fourth portion may correspond to a portion of the alloy component that includes the remaining fraction of the first portion and the remaining fraction of the second portion. As described above, the present disclosure is not limited to techniques for processing component including only first and second portions, and may include three or more portions.

In any case, the alloy component may be maintained at the substantially uniform temperature 130 or the first and second temperatures for a sufficient amount of time to allow at least some of the precipitate phase domains to dissolve and the primary precipitate phase domains to coarsen a desired amount. In some examples, when different average precipitate phase domain sizes are desired in the first and second portions of the alloy component, the first and second portions may be heated for different lengths of time. For example, the first and second portions may be heated to a substantially uniform temperature initially, and the second portion may be maintained at this temperature for a longer time, while the first portion is cooled to a temperature below the transition temperature 32. This may be accomplished by, for example, heating the first and second portions with separately controllable inductive heating coils. As another example, the first and second portion may be heated to first and second temperatures, and may also be heated for different lengths of time. For example, the second portion may be heated to a higher temperature than the first portion, and may also be heated for a longer time than the first portion. By heating a portion of the alloy component for a longer time, further dissolution of at least some of the precipitate phase domains and primary precipitate phase domain coarsening may be facilitated.

Once the desired dissolution of at least some of the precipitate phase domains and/or coarsening of the primary precipitate phase domains has occurred, a first portion of the alloy component may be cooled at a first cooling rate 132 (22) and a second portion of the alloy component may be cooled at a second cooling rate 134 (24). As described in further detail above, the first and second cooling rates 132 and 134 may facilitate substantially independent control over the sizes of the secondary and/or tertiary precipitate phase domains formed in the first and second portions of the alloy component during cooling. For example, the first cooling rate 132 is greater than the second cooling rate 134, and may result in the formation of smaller secondary and/or tertiary precipitate phase domains in the first portion of the alloy component than in the second portion of the alloy component.

In some embodiments, following the cooling of the first and second portions at first and second cooling rates 132 and 134, the alloy component may be aged (116). As illustrated in FIGS. 10A and 10B, aging may comprise heating 136 the component to an aging temperature 138 that facilitates further coarsening of tertiary precipitate phase domains throughout the alloy component. In some embodiments, the sizes of any primary and/or secondary precipitate phase domains may be substantially unaffected by aging. For example, the alloy component may be aged at a temperature between approximately 1400° F. and approximately 1700° F. Following aging, the component is cooled 140 to room temperature. While not shown or described with reference to the other figures, the alloy component may be aged upon completion of any embodiment of the techniques described above.

The techniques described above, which include heating the alloy component to a temperature or temperatures either above or below the transition temperature 32 prior to aging the component, are not the only techniques that may be used to selectively control average precipitate phase domain size in one or more portion of an alloy component. In other embodiments, first and second average precipitate phase domain sizes may be formed by selectively coarsening, or growing, the precipitate phase domains in one or both of a first portion and a second portion of the alloy component after aging the alloy component. For example, FIGS. 11 and 12 illustrate one technique according to which a precipitate phase domain may be selectively coarsened in a first portion of an alloy component.

Figure 11:
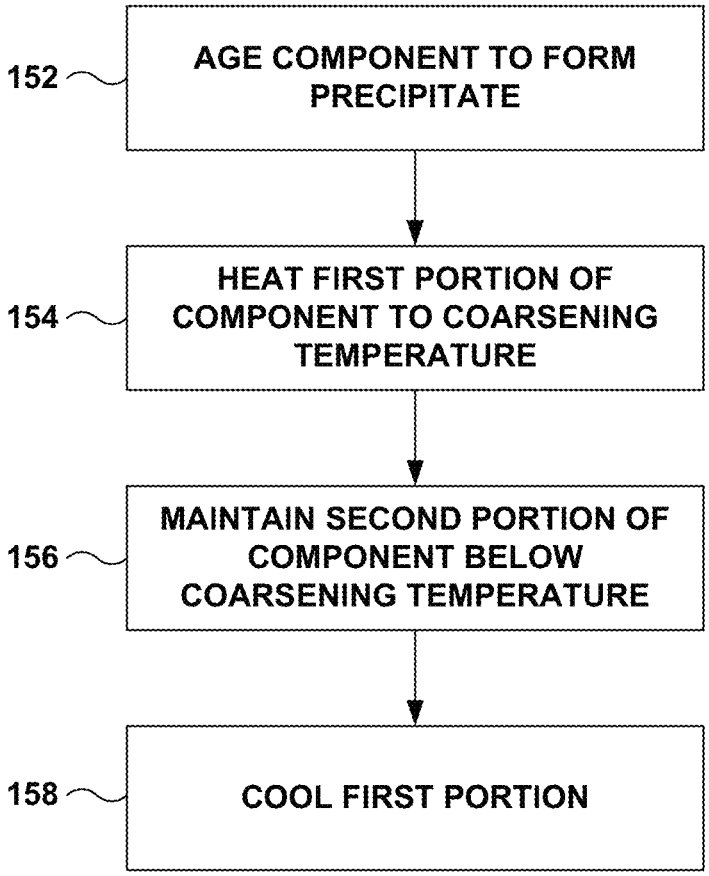
FIG. 11 is a flow diagram illustrating an example technique of heating a portion of an alloy component to coarsen a precipitate phase domain size.
Figure 12:
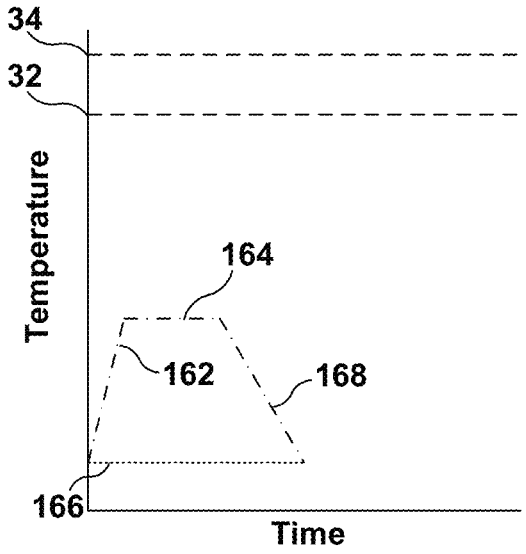
FIG. 12 is a time-temperature diagram illustrating an example heat treatment to which an alloy component may be exposed to coarsen the precipitate phase domain size.

In the technique illustrated in FIGS. 11 and 12, the alloy component is first aged to form tertiary precipitate substantially throughout the component (152). As described above, the aging step may be performed after heat-treatment steps that pre-condition the grain structure and form initial precipitate phase domains in the component. The aging process may facilitate tertiary precipitate phase domain growth throughout the alloy component, and may result in some tertiary precipitate phase domains being formed throughout substantially the entire component.

Once the component has been aged, a first portion of the alloy component may be heated, as represented by portion 152 of the time-temperature curve shown in FIG. 12, to a coarsening temperature 164 (154). The coarsening temperature may be a temperature that facilitates tertiary precipitate phase domain coarsening. For example, in embodiments in which the alloy component comprises a $\gamma$-Ni+$\gamma'$-$Ni_3Al$ alloy, the coarsening temperature may be between approximately 1400° F. and approximately 1700° F.

The time for which the alloy component is coarsened may be dependent upon the composition of the alloy and the temperature at which the component is coarsened. Generally, the coarsening time may range from approximately 30 seconds to approximately 16 hours. For example, the tertiary precipitate phase domains in the first portion of the alloy component may be coarsened in a one-hour batch process in a furnace or radiative heat source, or in a two minute inductive heating process.

While the first portion of the alloy component is heated, a second portion of the alloy component may be maintained at a temperature below a temperature at which tertiary precipitate phase domain coarsening may occur (156). For example, as shown in FIG. 12, the second portion of the alloy component may be maintained at substantially the same temperature 166, which may be room temperature, or may be an elevated temperature that is below a temperature at which growth of the precipitate phase domains in the second portion may occur. That is, in some embodiments, the second portion is not heated, but is maintained at room temperature.

In some embodiments, the second portion is maintained at the temperature below which precipitate phase domain coarsening may occur through use of an insulative shielding which limits or prevents heating of the second portion. In other embodiments, the second portion may be actively cooled. For example, the second portion may be exposed to a cooling medium, such as air, water, oil, or the like to cool the second portion and maintain a temperature in the second portion below the temperature at which precipitate phase domain coarsening may occur. The cooling medium may be substantially stagnant, or may be forced over the second portion of the alloy component.

Once the first portion has been heated to the coarsening temperature 164 for a time that allows the desired tertiary precipitate phase domain coarsening, the first portion may be cooled 168 (158), and heat treatment of the alloy component may be complete. As described above, the cooling may be accomplished by cooling media known in the art, such as air, other gases, liquids such as water or oil, or the like. The cooling media may be forced over the first portion, or the first portion may be passively cooled, e.g., cooled by a stagnant cooling medium.

The alloy components that are exposed to any of the heat processing techniques described herein may be, for example, an alloy component that has been worked or machined into its final shape, e.g., a turbine disk, or may be an alloy component which is in a rough or intermediate shape, e.g., unformed alloy pieces, or partially-formed alloy pieces. In some embodiments, the techniques described herein may be applied to the alloy component to form substantially symmetric portions, e.g., a turbine disk in which the bore portion comprises a first average precipitate phase domain size and a rim portion comprises a second, different average precipitate phase domain size. In other embodiments, the techniques may be applied to form an alloy component that is not symmetric, e.g., a hammer that has a first average precipitate phase domain size in the head and a second, different average precipitate phase domain size in the claw.

While the foregoing description has been directed to a number of individual embodiments, features and techniques of the individual embodiments may be used together or combined in ways not explicitly described herein without departing from the scope of the disclosure. For example, a differential temperature sub-transition temperature heat treatment followed by a single cooling rate, as described with respect to FIGS. 7 and 8, may be utilized in combination with a prior super-solvus heat treatment step, may be utilized in combination with an aging or differential aging step, or both. As another example, a differential aging step may be used in combination with any other technique described herein. Other combinations will be apparent to those of ordinary skill in the art, and are within the scope of the following claims.

EXAMPLES

Example 1

Figures 13A, 13B, 13C:
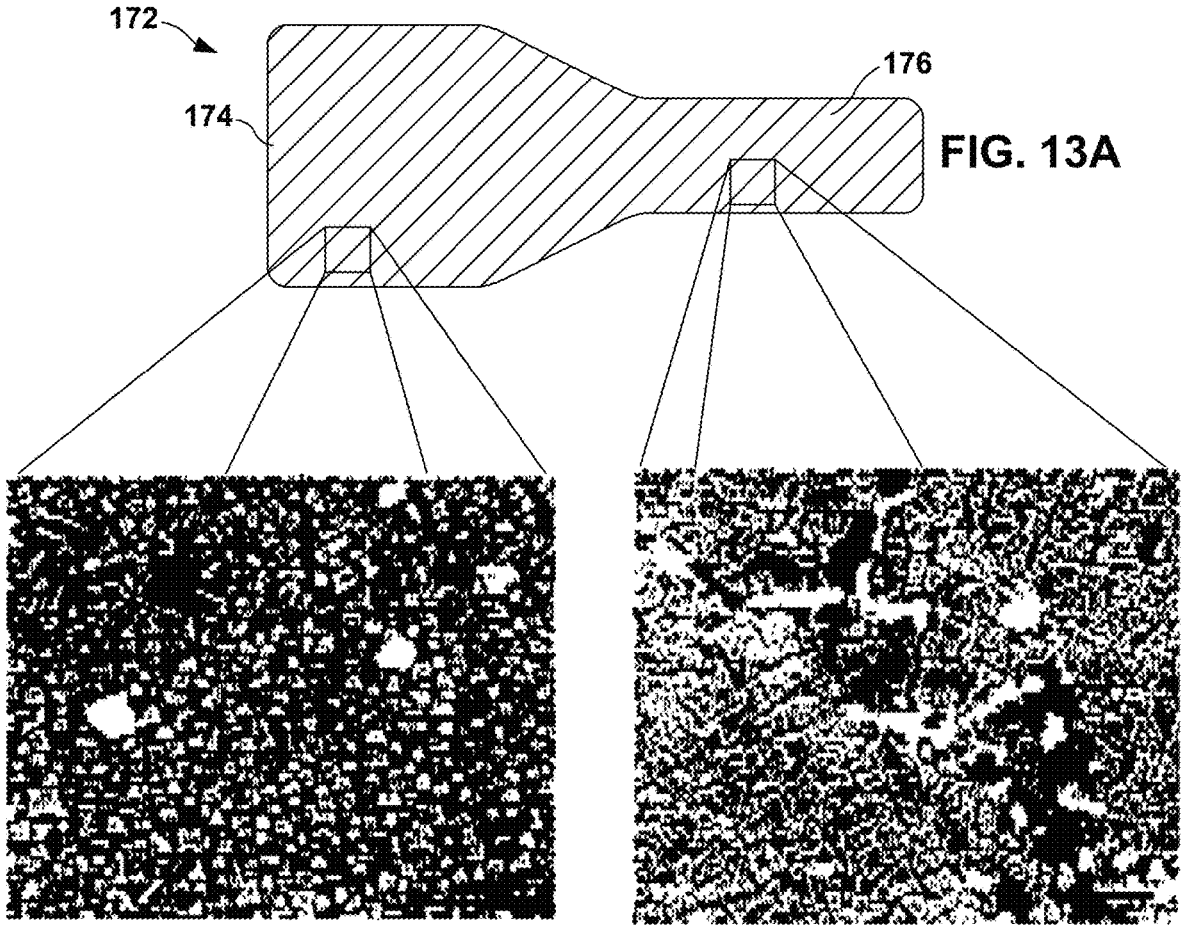
FIGS. 13A-13C illustrate an example article including a first portion having a fine precipitate phase domain size and a second portion having a coarse precipitate phase domain size.

FIGS. 13A-13C illustrate the results of a heat treatment process applied to a gas turbine engine disk 172 comprising a $\gamma$-Ni+$\gamma'$-$Ni_3Al$ alloy. The gas turbine engine disk 172 includes a bore portion 174 and a rim portion 176. Bore portion 174 was cooled at a rate of approximately 200° F. per minute and rim portion 176 was cooled at a rate of approximately 5° F. per minute. As FIGS. 13B and 13C show, the heat treatment process resulted in precipitate phase domains having a smaller average size in the bore portion 174 and precipitate phase domains having a larger average size in the rim portion 176.

Example 2

A nickel-based superalloy sample was locally heat treated using a high frequency induction power source. An objective of the heat treatment was to locally dissolve and/or coarsen tertiary $\gamma'$-$Ni_3Al$ and thereby enhance dwell fatigue life of the sample.

The local heat treatment generally proceeded according to the example illustrated with respect to FIGS. 11 and 12, described above. In particular, the superalloy sample was first aged to form tertiary $\gamma'$-$Ni_3Al$ substantially throughout the sample. A first portion of the superalloy sample, located at a root of a stress concentration feature, was then heated to coarsen tertiary $\gamma'$-$Ni_3Al$ in this portion of the sample. A second portion of the superalloy sample was maintained below a coarsening temperature of $\gamma'$-$Ni_3Al$ for the nickel-based superalloy during the heat treatment applied to the first portion of the sample. Once the heat treatment was complete and the sample cooled to room temperature, field emission scanning electron microscopy was used to evaluate the $\gamma'$-$Ni_3Al$ morphology. Additionally, carbon replica transmission electron microscopy was employed selectively to evaluate fine tertiary $\gamma'$-$Ni_3Al$.

Figure 14:
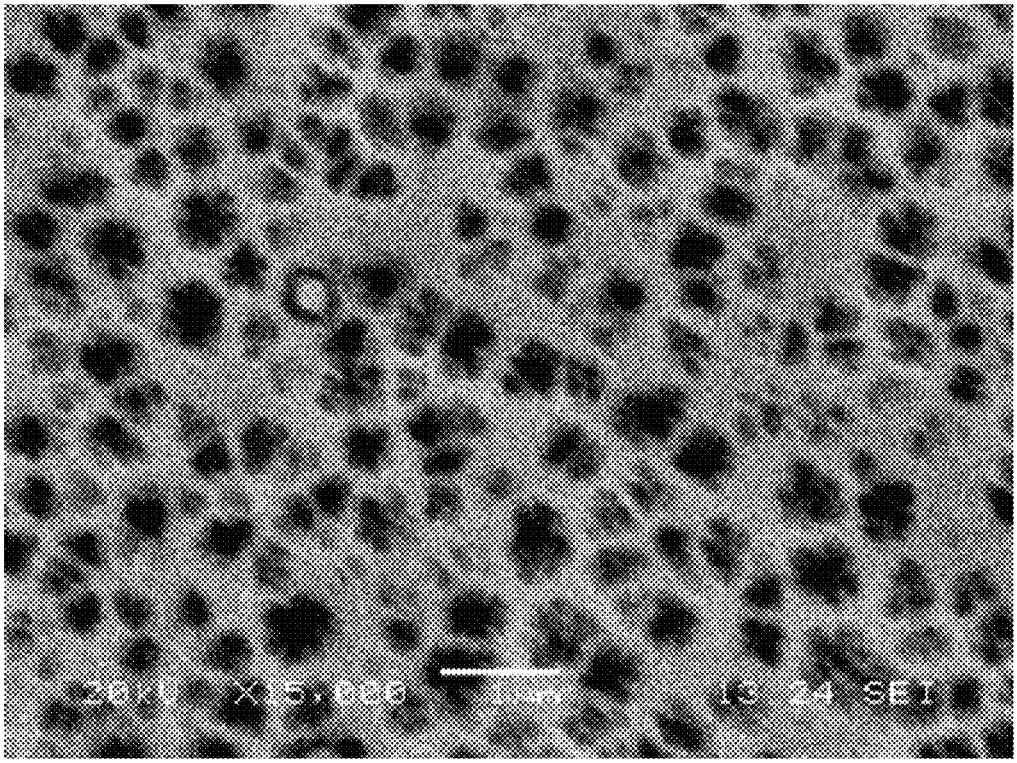
FIG. 14 is a micrograph of an example alloy component including secondary gamma prime morphology.
Figure 15:
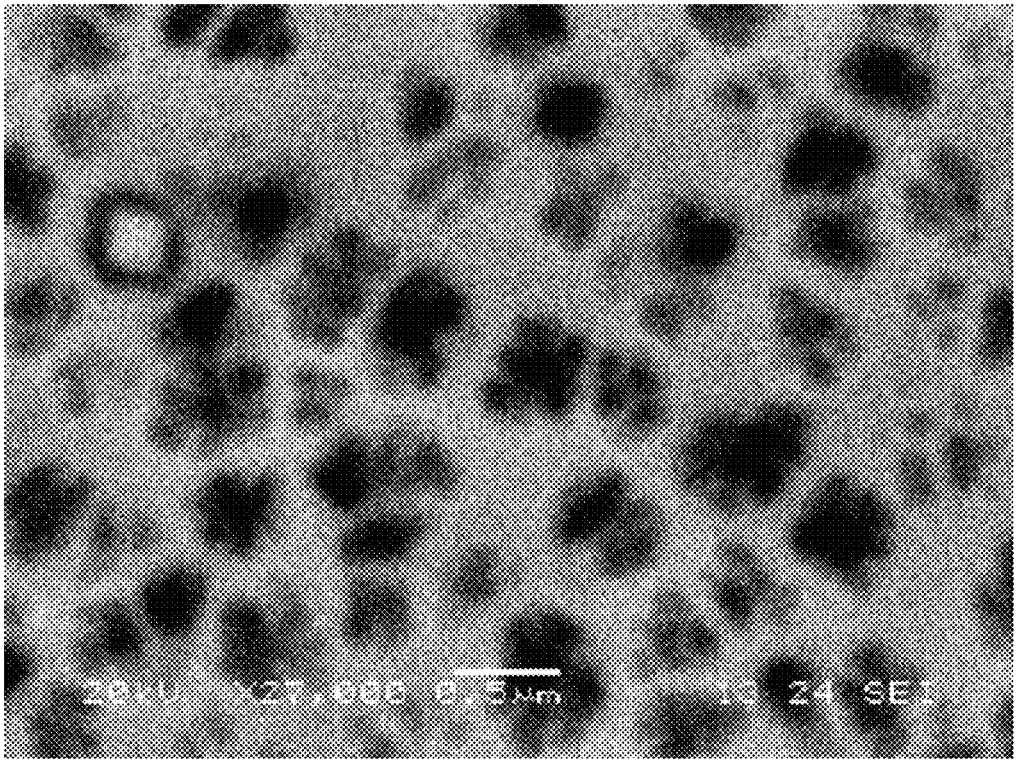
FIG. 15 is a micrograph showing the example alloy component of FIG. 14 at higher magnification.

FIG. 14 is a field emission scanning electron microscopy image of part of the second portion of the superalloy sample, which did not receive the local heat treatment. FIG. 15 is a field emission scanning electron microscopy image of the same part, shown at higher magnification that FIG. 14. FIGS. 14 and 15 show secondary $\gamma'$-$Ni_3Al$ morphology in the second portion of the superalloy sample, which did not receive the local heat treatment.

Figure 16:
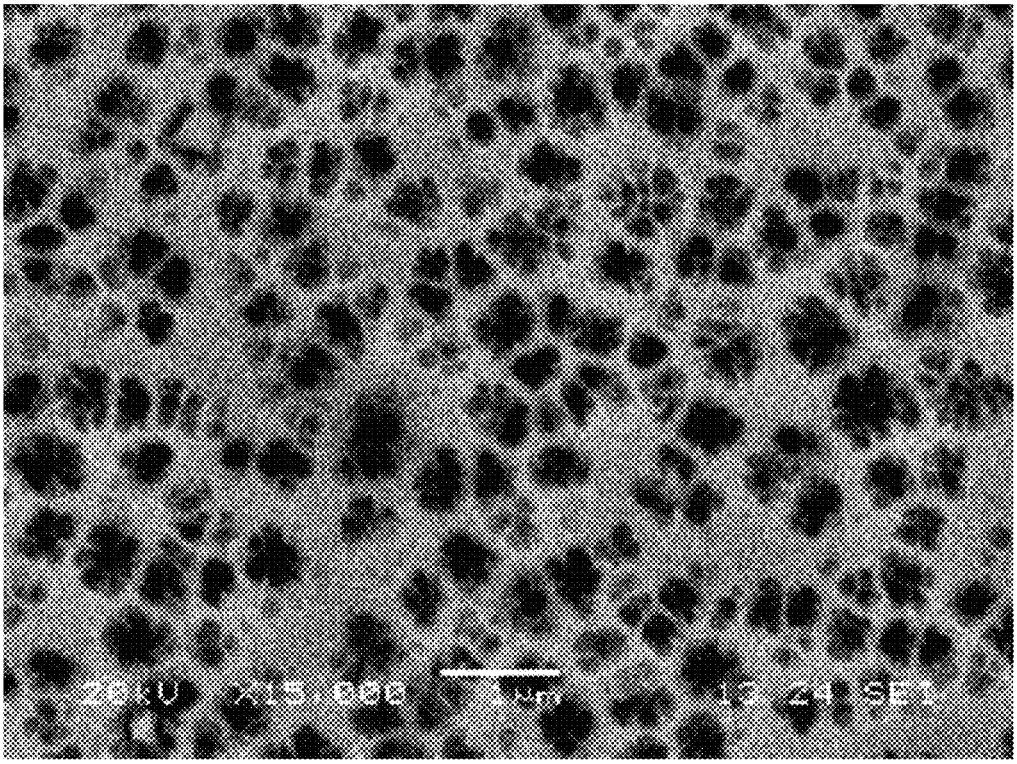
FIG. 16 is a micrograph of an example alloy component including secondary gamma prime morphology after local heat treatment.
Figure 17:
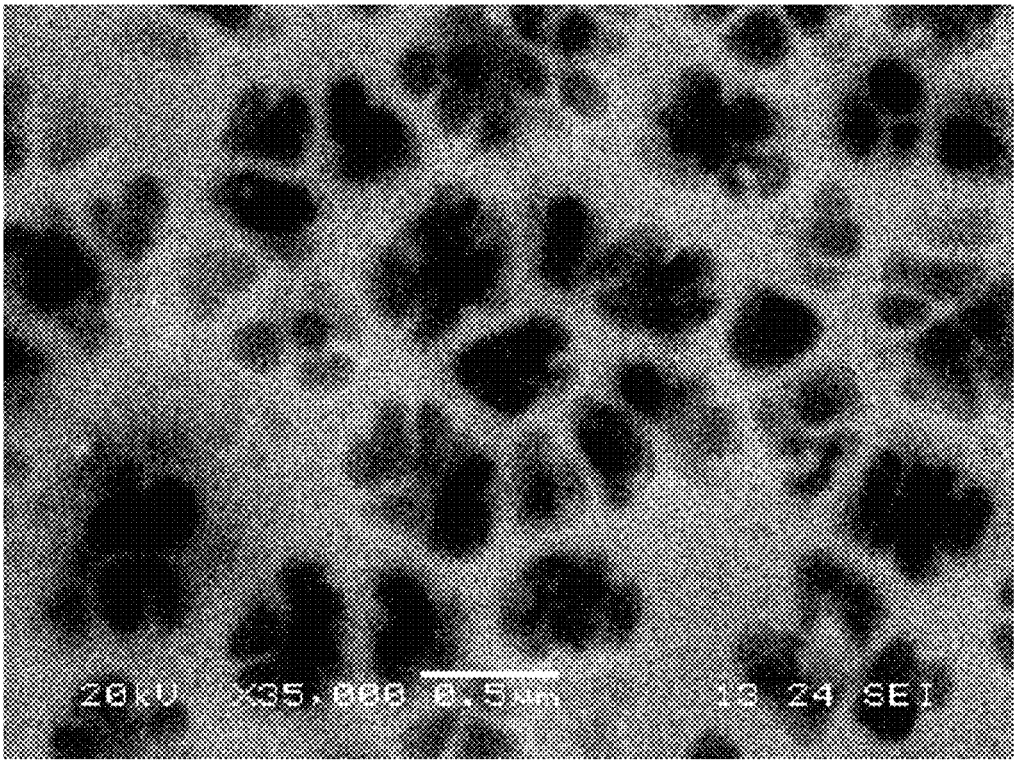
FIG. 17 is a micrograph showing the example alloy component of FIG. 16 at higher magnification.

FIG. 16 is a field emission scanning electron microscopy image of part of the first portion of the superalloy sample, which received the local heat treatment. FIG. 17 is a field emission scanning electron microscopy image of the same part, shown at higher magnification that FIG. 16. FIGS. 16 and 17 show secondary $\gamma'$-$Ni_3Al$ morphology in the second portion of the superalloy sample, which received the local heat treatment. Note that the secondary $\gamma'$-$Ni_3Al$ morphology was not altered substantially by the local heat treatment.

Figure 18:
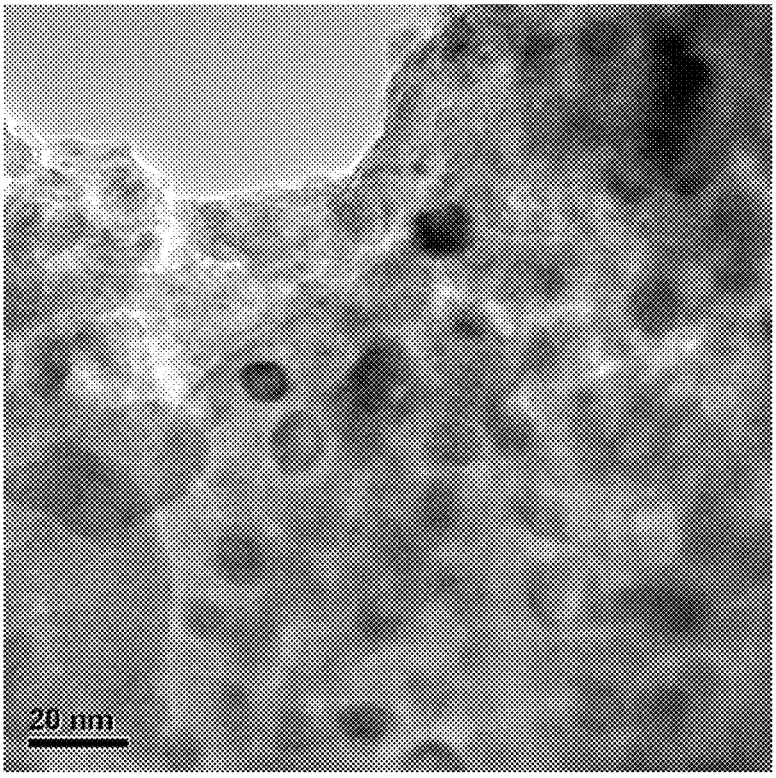
FIG. 18 is a micrograph of an example alloy component including tertiary gamma prime morphology.
Figure 19:
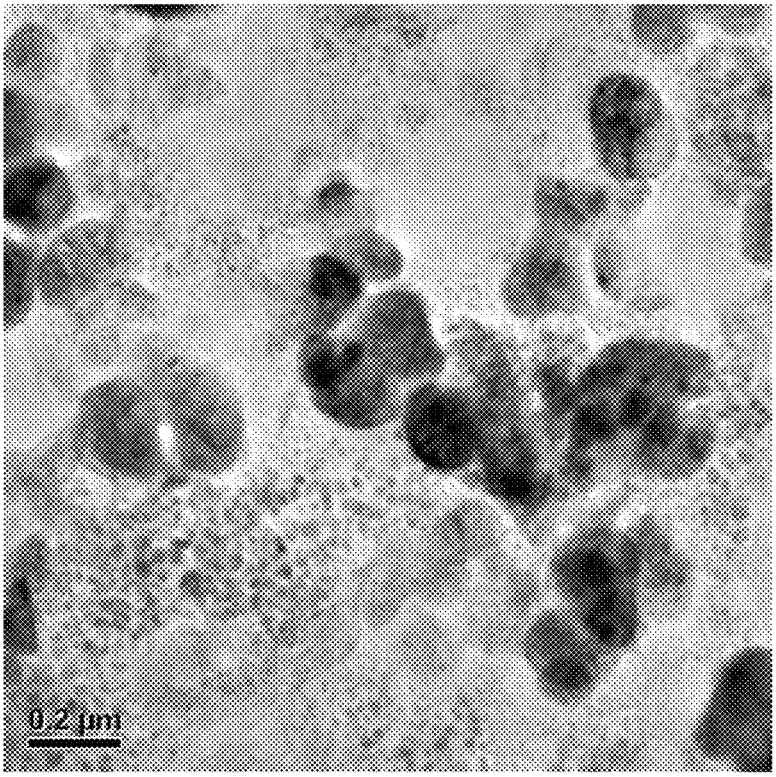
FIG. 19 is a micrograph showing the example alloy component of FIG. 18 at higher magnification.

FIG. 18 is a field emission scanning electron microscopy image of part of the second portion of the superalloy sample, which did not receive the local heat treatment. FIG. 19 is a field emission scanning electron microscopy image of the same part, shown at higher magnification that FIG. 18. FIGS. 18 and 19 show tertiary $\gamma'$-$Ni_3Al$ morphology in the second portion of the superalloy sample, which did not receive the local heat treatment.

Figure 20:
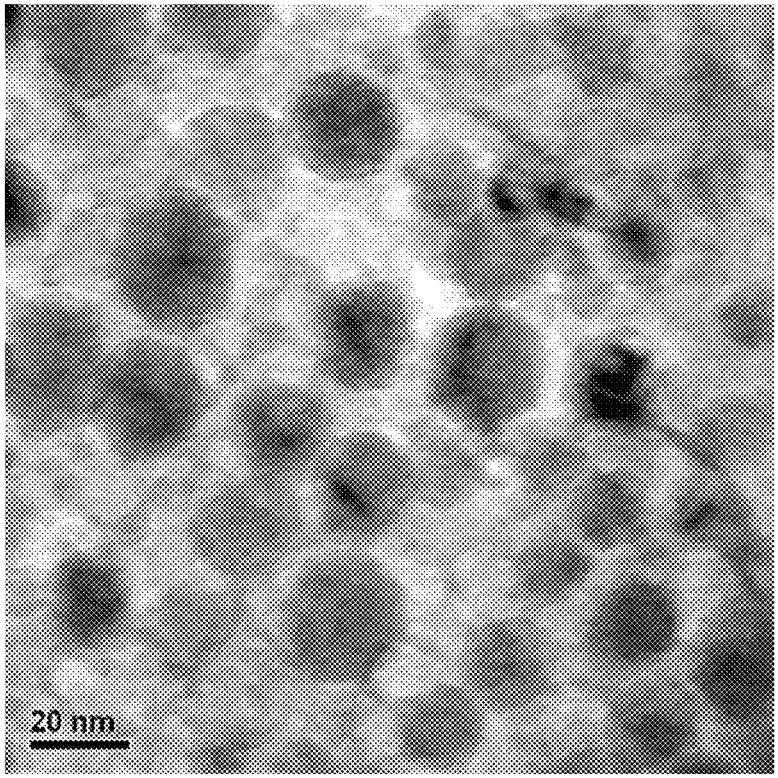
FIG. 20 is a micrograph of an example alloy component including tertiary gamma prime morphology after local heat treatment.
Figure 21:
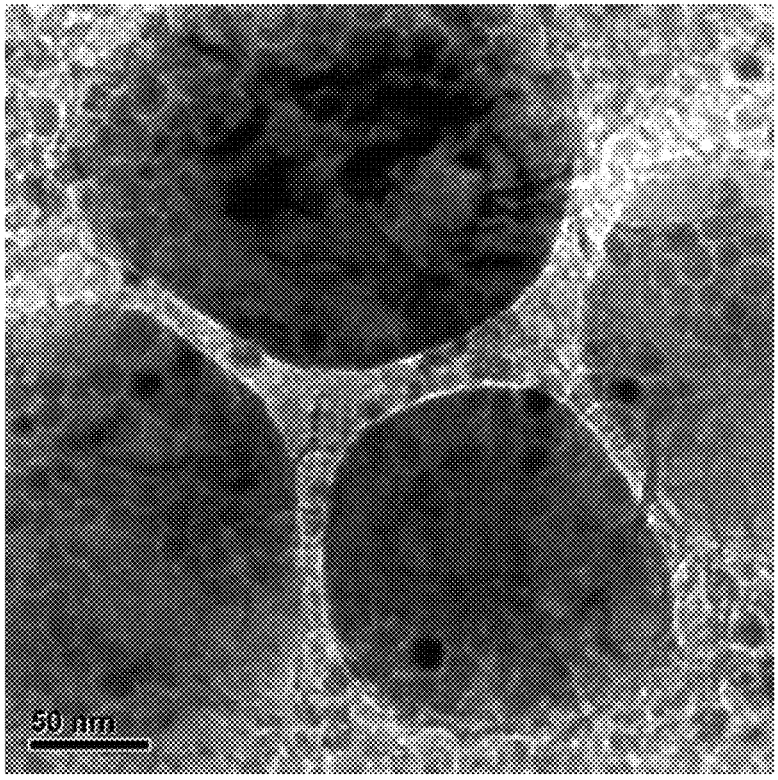
FIG. 21 is a micrograph showing the example alloy component of FIG. 20 at higher magnification.

FIG. 20 is a field emission scanning electron microscopy image of part of the first portion of the superalloy sample, which received the local heat treatment. FIG. 21 is a field emission scanning electron microscopy image of the same part, shown at higher magnification that FIG. 20. FIGS. 20 and 21 show tertiary $\gamma'$-$Ni_3Al$ morphology in the second portion of the superalloy sample, which received the local heat treatment. Note that the tertiary $\gamma'$-$Ni_3Al$ morphology was coarsened by the local heat treatment.

Various embodiments have been described. These and other embodiments are within the scope of the following claims.

The invention claimed is:

1. A method comprising:

heat treating a first portion of an alloy component by heating the first portion of an alloy component to a first temperature and maintaining the first portion of the component at the first temperature for a first selected duration, wherein the first temperature is below a transition temperature of the alloy component and above a minimum temperature sufficient to initiate precipitate domain formation;

heat treating a second portion of the alloy component by heating the second portion of the alloy component to a second temperature and maintaining the second portion of the component at the second temperature for a second selected duration, wherein the second temperature is below the transition temperature of the alloy component and above the minimum temperature sufficient to initiate precipitate domain formation, and wherein the second temperature is different than the first temperature;

cooling the first portion directly from the first temperature and the second portion directly from the second temperature to result in a first plurality of precipitate phase domains comprising a first average size in the first portion and a second plurality of precipitate phase domains comprising a second average size in the second portion, wherein the first average size is different than the second average size.

2. The method of claim 1, wherein the alloy component comprises a $\gamma$-Ni+$\gamma'$-$Ni_3Al$ alloy, and wherein the transition temperature of the alloy component comprises a $\gamma'$-$Ni_3Al$ solvus temperature.

3. The method of claim 1, wherein the alloy component comprises a Ti alloy, and wherein the transition temperature comprises a $\beta$ transus temperature.

4. The method of claim 1, wherein cooling the first portion directly from the first temperature and the second portion directly from the second temperature comprises cooling the first portion and the second portion at a substantially similar cooling rate.

5. The method of claim 1, wherein cooling the first portion directly from the first temperature and the second portion directly from the second temperature comprises cooling the first portion at a first cooling rate and cooling the second portion at a second cooling rate different than the first cooling rate.

6. The method of claim 5, wherein cooling the first portion at the first cooling rate comprises cooling the first portion of the alloy component at a first cooling rate greater than approximately 200° F. per minute, and wherein cooling the second portion at the second cooling rate comprises cooling the second portion of the alloy component at a second cooling rate less than approximately 120° F. per minute.

7. The method of claim 1, further comprising pre-conditioning a grain structure of the alloy component prior to cooling the first portion of the alloy component and cooling the second portion of the alloy component.

8. The method of claim 1, further comprising coarsening at least some of the first plurality of precipitate phase domains and the second plurality of precipitate phase domains at an elevated temperature.

* * * * *